US008676096B2

(12) United States Patent
Koshimori

(10) Patent No.: US 8,676,096 B2
(45) Date of Patent: Mar. 18, 2014

(54) POWDER CONTAINER AND IMAGE FORMING APPARATUS

(71) Applicant: Fuji Xerox Co., Ltd., Tokyo (JP)

(72) Inventor: Kazunori Koshimori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/727,452

(22) Filed: Dec. 26, 2012

(65) Prior Publication Data

US 2013/0216273 A1 Aug. 22, 2013

(30) Foreign Application Priority Data

Feb. 21, 2012 (JP) ..... 2012-035557
Jul. 20, 2012 (JP) ..... 2012-162032

(51) Int. Cl.
*G03G 15/08* (2006.01)

(52) U.S. Cl.
CPC ..... *G03G 15/0881* (2013.01); *G03G 15/0886* (2013.01)
USPC ..... 399/262; 399/260; 399/258

(58) Field of Classification Search
CPC ..... G03G 15/0886; G03G 2215/067; G03G 2215/0692
USPC ..... 399/260, 262, 258
See application file for complete search history.

(56) References Cited

U.S. PATENT DOCUMENTS 5,489,976 A 2/1996 Ichikawa
5,933,691 A 8/1999 Johroku
6,438,345 B1 8/2002 Ban et al.
7,295,798 B2 * 11/2007 Koyama ..... 399/258
2003/0223782 A1 12/2003 Ban et al.
2006/0182469 A1 8/2006 Koyama et al.
2006/0285885 A1 * 12/2006 Lee ..... 399/262
2009/0238608 A1 9/2009 Murase et al.
2010/0226690 A1 9/2010 Kadota et al.

FOREIGN PATENT DOCUMENTS

JP A-7-281519 10/1995
JP A-2000-347493 12/2000
JP A-2003-280347 10/2003

(Continued)

OTHER PUBLICATIONS

Apr. 29, 2013 Office Action issued is Australian Patent Application No. 2013200135.

(Continued)

*Primary Examiner* — David Gray
*Assistant Examiner* — Andrew Do
(74) *Attorney, Agent, or Firm* — Oliff PLC

(57) ABSTRACT

A powder container includes a body and a pair of walls that block one end of the body and the other end. The powder container is mountable in an apparatus. The body has an opening in a location closer to the one end to supply the powder to the apparatus. The powder container includes a shutter, a guide portion and a boss. The shutter is situated in a closed location before the powder container is mounted in the apparatus and is moved to an opened location to open the opening when the powder container is mounted in the apparatus. The guide portion maintains the shutter on the body and guides the shutter. The boss is located between the shutter and an outer wall surface of the one of walls and next to the end of the shutter at the closed location in a movement direction of the shutter.

5 Claims, 35 Drawing Sheets

(56) References Cited

FOREIGN PATENT DOCUMENTS

| | | |
|---|---|---|
| JP | A-2005-107141 | 4/2005 |
| JP | A-2007-178972 | 7/2007 |
| JP | A-2009-229938 | 10/2009 |
| JP | A-2010-282238 | 12/2010 |
| KR | A-10-2004-0021508 | 3/2004 |
| KR | A-10-2010-0070365 | 6/2010 |

OTHER PUBLICATIONS

May 28, 2013 Notice of Preliminary Rejection issued in Korean Application No. 10-2013-0005587 with English-language translation.

* cited by examiner

POWDER CONTAINER AND IMAGE FORMING APPARATUS

CROSS-REFERENCE TO RELATED APPLICATIONS

This application is based upon and claims the priority under 35 USC 119 from Japanese Patent Application Nos. 2012-035557 (filed on Feb. 21, 2012) and 2012-162032 (filed on Jul. 20, 2012).

BACKGROUND

1. Technical Field

The present invention relates to a powder container and an image forming apparatus.

2. Related Art

A powder container for accommodating a powder is used in various fields. For example, a toner cartridge for accommodating toner which is powder developing agent is used in electrophotography type printers.

SUMMARY OF THE INVENTION (1) According to an aspect of the invention, a powder container includes:

a body; and a pair of walls that block one end in a longitudinal direction of the body and the other end of the body, respectively, the powder container accommodating powder therein and being mounted in an apparatus that uses the powder, wherein the body has an opening in a location closer to the one end of the body to supply the powder within the powder container to the apparatus, and wherein the powder container further includes:

a shutter that is situated in a closed location to block the opening before the powder container is mounted in the apparatus and is moved along an outer peripheral surface of the body to an opened location to open the opening in a state where the powder container is mounted in the apparatus, a guide portion that maintains the shutter on the body and guides a movement of the shutter, and a boss that is positioned in a location between the shutter and an outer wall surface of the one of walls in the longitudinal direction of the body and next to the end of the shutter disposed in the closed location in a movement direction of the shutter, and protrudes outward in a radial direction from a center line of the body in the longitudinal direction.

(2) In the powder container of (1), the guide portions are disposed in an inner side of the shutter.

(3) The powder container of (1) or (2) further includes a blocking hook formed in a location adjacent to the end of the shutter disposed in the closed location. Before the powder container is mounted in the apparatus, the blocking hook protrudes up to a height to prevent the shutter disposed in the closed location from being moved from the closed location to the opened location, and by being mounted in the apparatus, the blocking hook is pressed by a member of the apparatus and pushed down up to a height to allow the movement of the shutter. The boss has a width in the movement direction of the shutter so that the boss is next to the end of the shutter and is next to the blocking hook with respect to the movement direction of the shutter.

(4) In the powder container of (3), the boss protrudes outward in the radial direction higher than a radial front end of the blocking hook in a protruding state from the center line.

(5) In the powder container of any of (1) to (4), the shutter receives an action from a movable member of the apparatus to open the opening in a state where the powder container is mounted in the apparatus, and the boss contacts with the movable member of the apparatus when the shutter moves from the closed location to the opened location by the movement of the movable member after the powder container is mounted in the apparatus and blocks a further movement of the movable member in a direction where the shutter is further opened.

(6) According to another aspect of the invention, an image forming apparatus is mounted with a powder container according to any one of (1) to (5) to form an image using the powder accommodated within the powder container.

With the configurations of (1) and (6), it may be possible to prevent leakage of inner powder as impact is applied to the shutter member that closes the opening through which the inner powder is supplied.

With the configuration of (2), the impact may be prevented from being applied to the guide portions directly.

With the configuration of (3), the movement blocking action of the shutter member by the blocking hook may be prevented from unfunctioning.

With the configuration of (4), the movement blocking action of the shutter member by the blocking hook may be more surely prevented from unfunctioning, as compared to a case where the height of the boss is equal to or lower than that of the blocking hook.

With the configuration of (5), it is possible to make the boss also carry out another action of assuming a role of position restriction when the shutter is opened.

BRIEF DESCRIPTION OF THE DRAWINGS

Exemplary embodiments of the invention will be described in detail based on the following figures, wherein.

DETAILED DESCRIPTION

Hereinafter, exemplary embodiments of the present invention will be described.

(Entire Construction)

Figure 1:
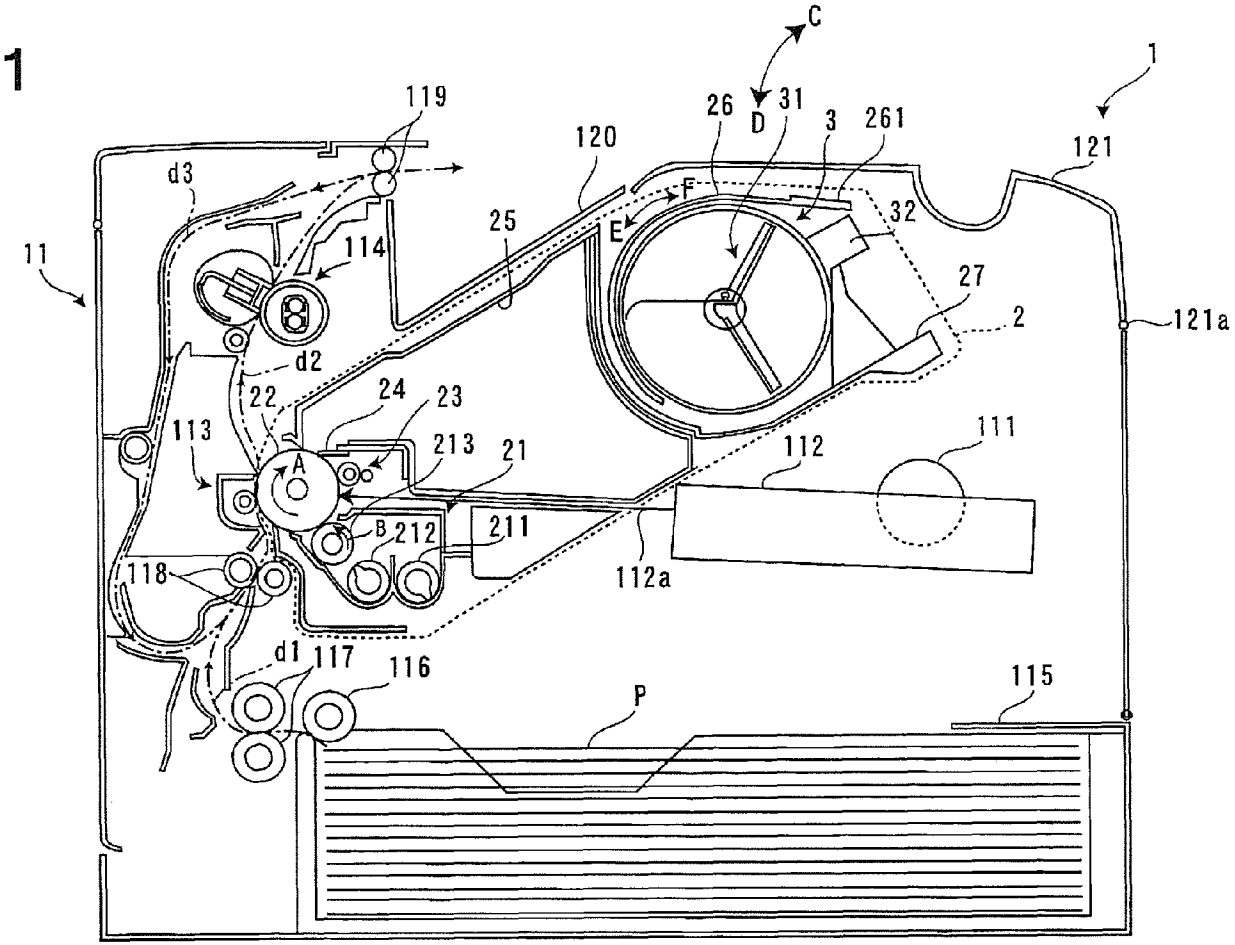
FIG. 1 is a schematic view of a printer to which a toner cartridge is mounted as an embodiment of a powder container according to the present invention.

FIG. 1 is a schematic view of a printer to which a toner cartridge is mounted as an embodiment of a powder container according to the present invention.

A printer 1 shown in FIG. 1 prints an image on a sheet of paper P by an electrophotography means, and a right side surface of FIG. 1 is taken as a front surface of the apparatus. The printer 1 is configured such that a process cartridge 2 is detachably mounted to a printer body 11 on a front side of the apparatus. Even when the process cartridge 2 remains mounted to the printer body 11, the toner cartridge 3 is detachably mounted to the process cartridge 2 on a front side of the apparatus.

Here, the toner cartridge 3 corresponds to an example of a powder container of the present invention, and a construction including the printer body 11 and the parts of the process cartridge 2 excluding the toner cartridge 3 corresponds to an example of the apparatus of the present invention.

A distributed toner is accommodated in the toner cartridge 3, and the toner in the toner cartridge 3 is agitated through rotation of an agitation member 31 in order to be prevented from cohering. A driving force is transferred to the agitation member 31 from the motor 111 installed in the printer body 11 through a gear (not shown). The toner in the toner cartridge 3 is supplied to the developing unit 21 installed in the process cartridge 2.

The process cartridge 2 includes a developing unit 21, a photosensitizer 22, a charging unit 23, and a cleaner 24, and a waste toner accommodating chamber 25 for accommodating waste toner scraped and collected on the photosensitizer 22 with the cleaner 24 is installed between the developing unit 21 or the photosensitizer 22 and the toner cartridge 3.

An exposure unit 112 for irradiating exposure light 112*a* toward the photosensitizer 22 and a transfer unit 113 disposed at a location opposite to the photosensitizer 22 are installed in the printer body 11.

Various operations as will be described are applied to the photosensitizer 22 while the photosensitizer 22 rotates in a direction of arrow A.

The charging unit 23 charges a surface of the photosensitizer 22 to a predetermined electric potential.

The exposure unit 112 irradiates the exposure light 112*a* according to an image signal to the charged surface of the photosensitizer 22 to form an electrostatic latent image on the surface of the photosensitizer 22.

A developing agent containing a carrier and a toner is accommodated in the developing unit 21, and circulates in a direction perpendicular to the paper of FIG. 1 through rotation of two augers 211, 212. The developing agent in the developing unit 21 is moved to a developing location opposite to the photosensitizer 22 by a developing roll 213 rotating in a direction of arrow B, and the electrostatic latent image on the photosensitizer 22 is developed by the toner in the developing agent to form a toner image on the photosensitizer 22.

The toner image formed on the photosensitizer 22 is transferred on the paper P fed, which will be described below through an operation of the transfer unit 113. The toner image on the paper P is heated and pressurized by a fixation unit 114 installed in the printer body 11 to be fixed on the paper P.

A paper cartridge 115 is mounted to a lower portion of the printer body 11 to be freely extractable to the right side of FIG. 1, and several sheets of paper P before printing are stacked and accommodated in the paper cartridge 115. In the printing, the uppermost one P of the papers P accommodated in the paper cartridge 115 is extracted by an extraction roller 116, and even when several sheets of paper P are extracted while being overlapped, only one sheet of paper P is separated by a separation roller 117 with a certainty to be conveyed on a conveying path d1, reaching a registration roll 118. The registration roll 118 corrects a posture of the conveyed paper and adjusts a conveying timing after that, and then, serves to send the paper toward a more downstream side. The paper is sent from the registration roll 118 according to the transfer timing of the toner image on the photosensitizer 22, and the tonner image on the photosensitizer 22 is transferred on the paper. The paper to which the toner image has been transferred is conveyed on a conveying path d2 and passes through the fixation unit 114 so that the toner image is fixed thereto, and is discharged onto a paper discharging table 120 installed at an upper portion of the printer body 11 by a paper discharging roll 119.

When both surfaces of a paper are printed, the paper printed on one surface with the above-mentioned way is sent to an intermediate location by the paper discharging roll 119, and thereafter, the paper discharging roll 119 is reversely rotated to convey the paper to a conveying path d3 and the paper reaches the registration roll 118 again. Thereafter, the aforementioned printing operation is repeated, so that the paper whose opposite surfaces have been printed is discharged onto the paper discharging table 120 by the paper discharging roll 119.

A cover 121 of the covers of the printer body 11 is configured to be freely opened and closed in a direction of arrow C-D about a hinge portion 121*a*, that is, on a front surface side of the apparatus. If the cover 121 is opened and a fixing member 26 is rotated in a direction of arrow E while a knob 261 of the semi-cylindrical fixing member 26 installed in the process cartridge 2 is gripped, an attaching opening for attaching the toner cartridge 3 is opened and the toner cartridge 3 can be withdrawn by pulling a knob 32 of the toner cartridge 3. When the toner cartridge 3 is mounted to the process cartridge 2, the reverse manipulation is performed. That is, the toner cartridge 3 is mounted to the process cartridge 2 while the knob 32 of the toner cartridge 3 is gripped by a hand, and the fixing member 26 is rotated in a direction of arrow F while the knob 261 of the fixing member 26 of the process cartridge 2 is gripped by the hand in turn. If the fixing member 26 is rotated in a direction of arrow F, the toner cartridge 3 is fixed to a predetermined location in the process cartridge 2. Thereafter, the cover 121 is closed in a direction of arrow D.

When the process cartridge 2 itself is replaced because, for example, the photosensitizer 22 is deteriorated, the cover 121 is opened, and then the process cartridge 2 is pulled out regardless of whether the toner cartridge 3 exists or not while a knob 27 of the process cartridge 2 is gripped. A new process cartridge 2 can be mounted through a reverse manipulation.

Figure 2:
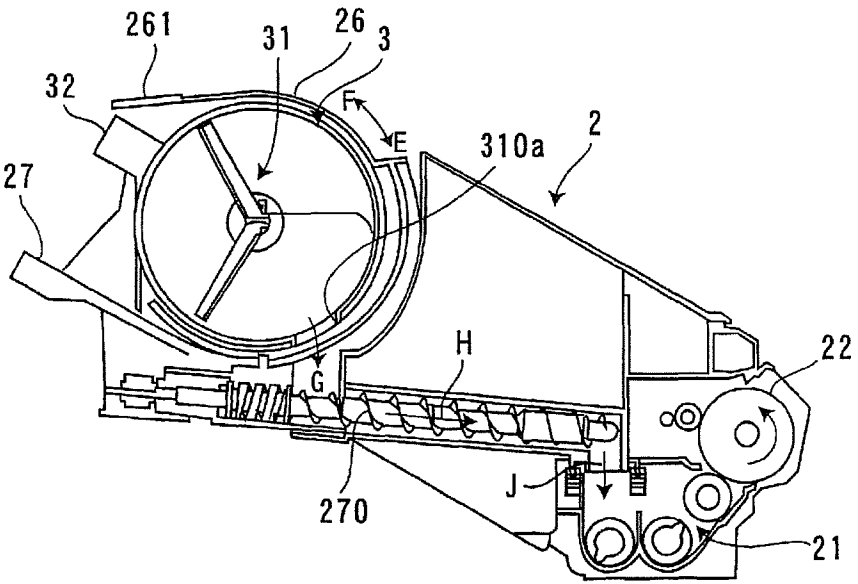
FIG. 2 is a sectional view of a process cartridge, taken along a plane different from that of FIG. 1, when viewed from a rear side of the paper of FIG. 1.

FIG. 2 is a sectional view of the process cartridge, taken along a plane different from that of FIG. 1, when viewed from a rear side of the paper of FIG. 1.

An opening 310*a* for supplying the interior toner toward the developing unit 21 is formed at a lower portion of the toner cartridge 3 in a mounted state of the toner cartridge 3. The opening 310*a* is configured to remain closed by the shutter when the toner cartridge 3 exists as a single body, and the shutter is opened if the fixing member 26 of the process cartridge 2 is rotated in a direction of arrow F as the toner cartridge 3 is mounted to the process cartridge 2. Details of the construction will be described below.

The toner accommodated in the toner cartridge 3 passes through the opening 310*a* and drops in a direction of arrow G, and is moved in a direction of arrow H through rotation of a rotating conveying member 270 and drops in a direction of arrow J to be supplied into the developing unit 21.

Figure 3:
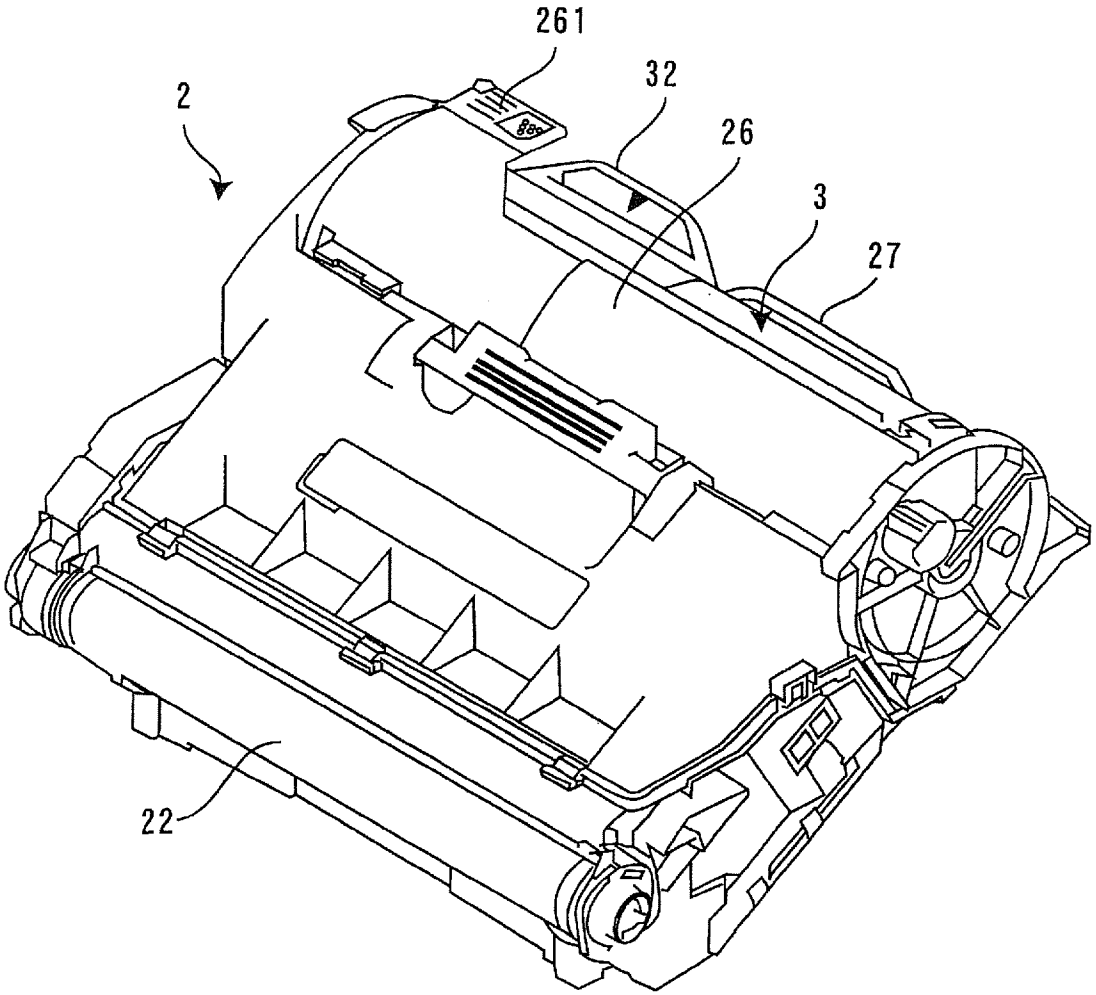
FIG. 3 is a perspective view illustrating an appearance of the process cartridge to which the toner cartridge is mounted, when viewed from a photosensitizer.

FIG. 3 is a perspective view illustrating an appearance of the process cartridge to which the toner cartridge is mounted, when viewed from a photosensitizer.

FIG. 3 shows the cylindrical photosensitizer 22 on the left lower side, and the toner cartridge 3 and the knob 32 thereof are shown on the right upper side. Almost all parts of the toner cartridge 3 are covered by the semi-cylindrical fixing member 26 installed in the process cartridge 2. In FIG. 3, the fixing member 26 is rotated in the direction of arrow F shown in FIGS. 1 and 2 to be in a state where the toner cartridge 3 is fixed to the process cartridge 2. FIG. 3 also shows the knob 261 for rotating the fixing member 26, and the knob 27 for pulling out the entire process cartridge 2 from the printer body 11 (see FIG. 1).

Figure 4:
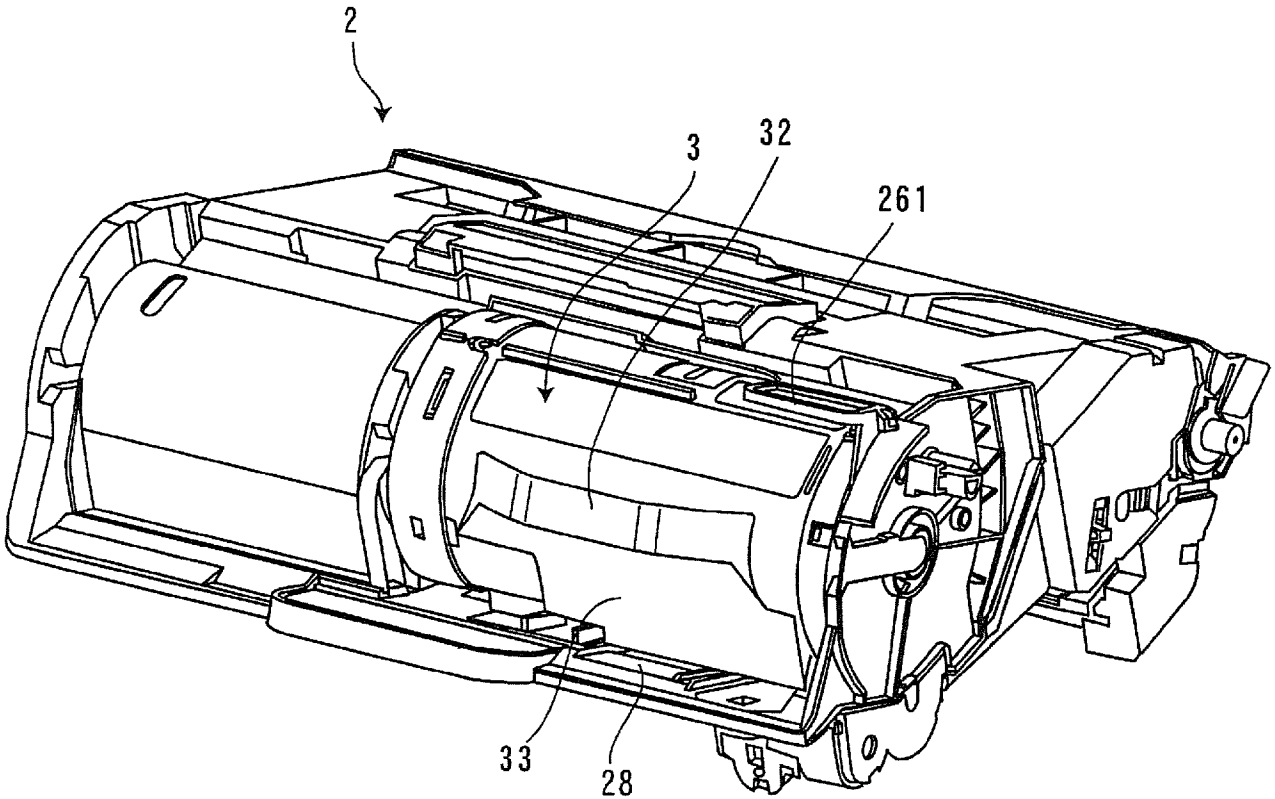
FIG. 4 is a perspective view illustrating an appearance of the process cartridge, when viewed from the toner cartridge mounted to the process cartridge.
Figure 5:
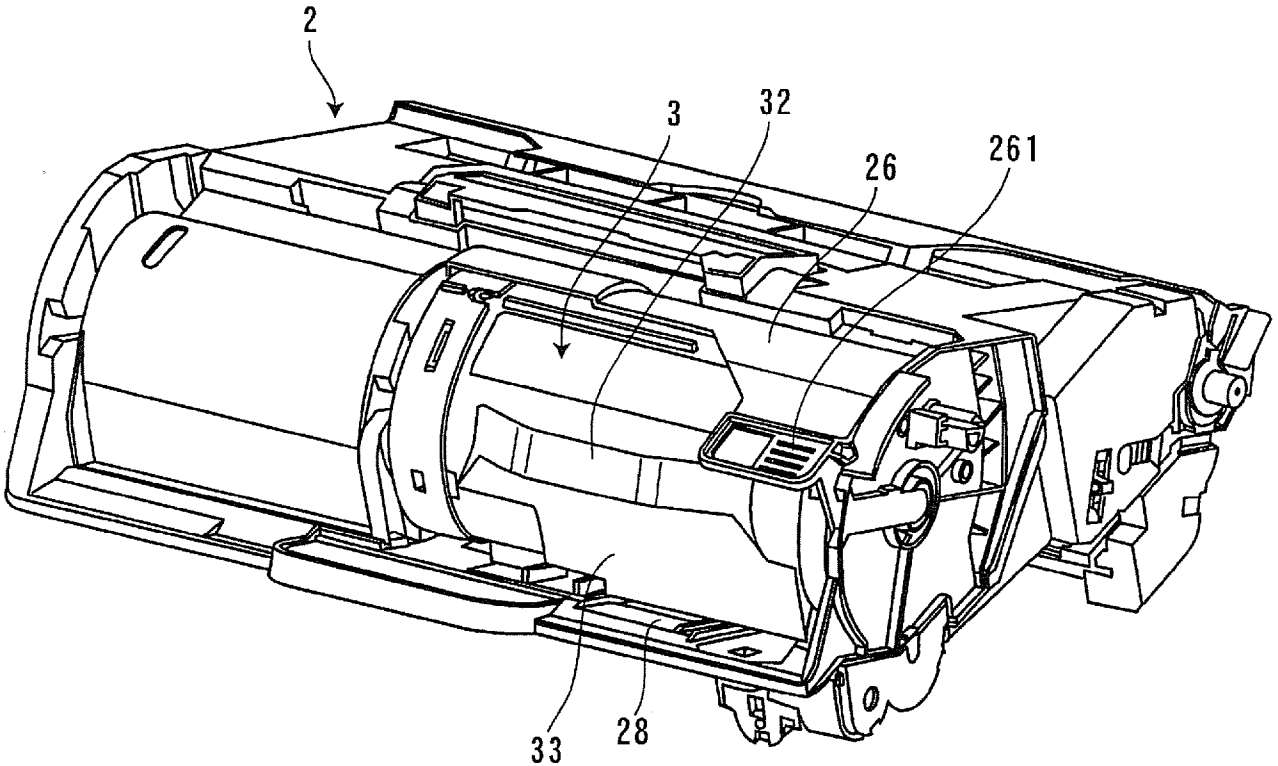
FIG. 5 is a perspective view illustrating an appearance of the process cartridge, when viewed from the toner cartridge mounted to the process cartridge.

FIGS. 4 and 5 are perspective views illustrating an appearance of the process cartridge, when viewed from the toner cartridge mounted to the process cartridge. Here, FIG. 4 is a perspective view illustrating a state where the fixing member 26 still remains opened in the direction of arrow E (see FIGS. 1 and 2) after the toner cartridge 3 is mounted to the process cartridge 2. FIG. 5 is a perspective view illustrating a state where the toner cartridge 3 is fixed to the process cartridge 2 by rotating the fixing member 26 in the direction of arrow F (see FIGS. 1 and 2).

A planar shield 33 is spread out at a lower portion of the knob 32 of the toner cartridge 3. In a state where the toner cartridge 3 is mounted to the process cartridge 2, the shield 33 is spread out to a location close to the bottom 28 of the inner wall surfaces of the process cartridge 2 defining a space for receiving the toner cartridge 3.

Figure 6:
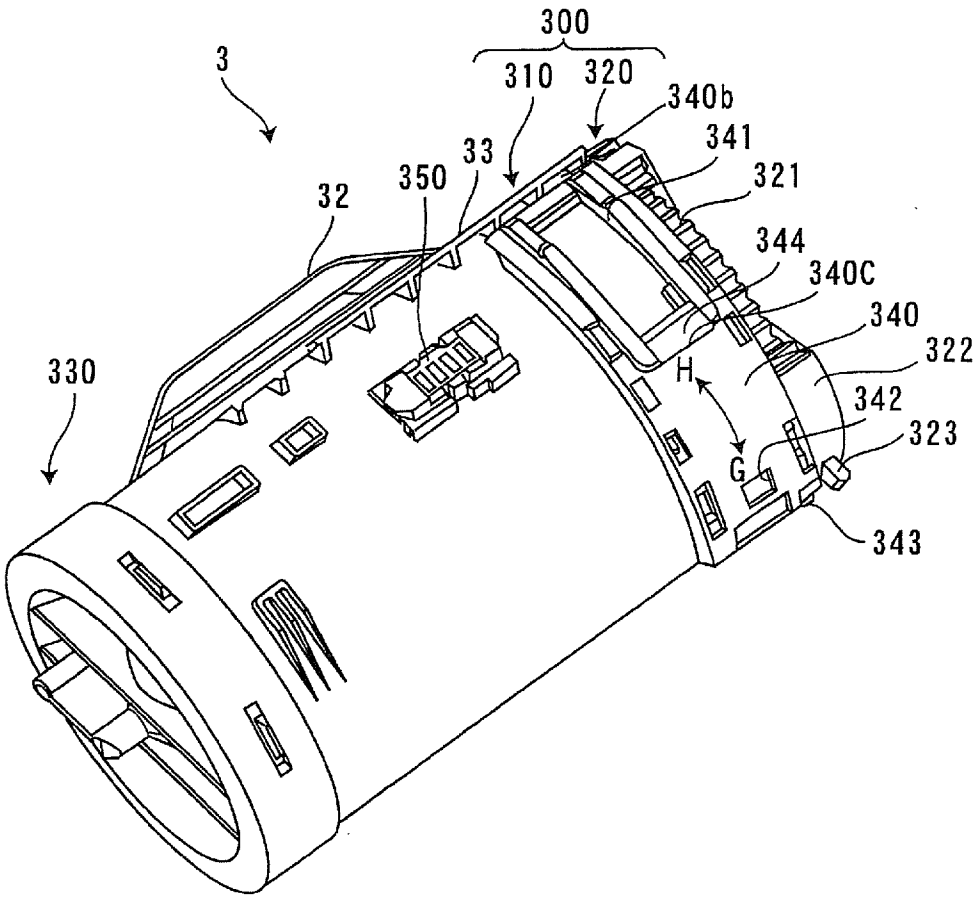
FIG. 6 is a perspective view illustrating an appearance of the toner cartridge as a single body.
Figure 7:
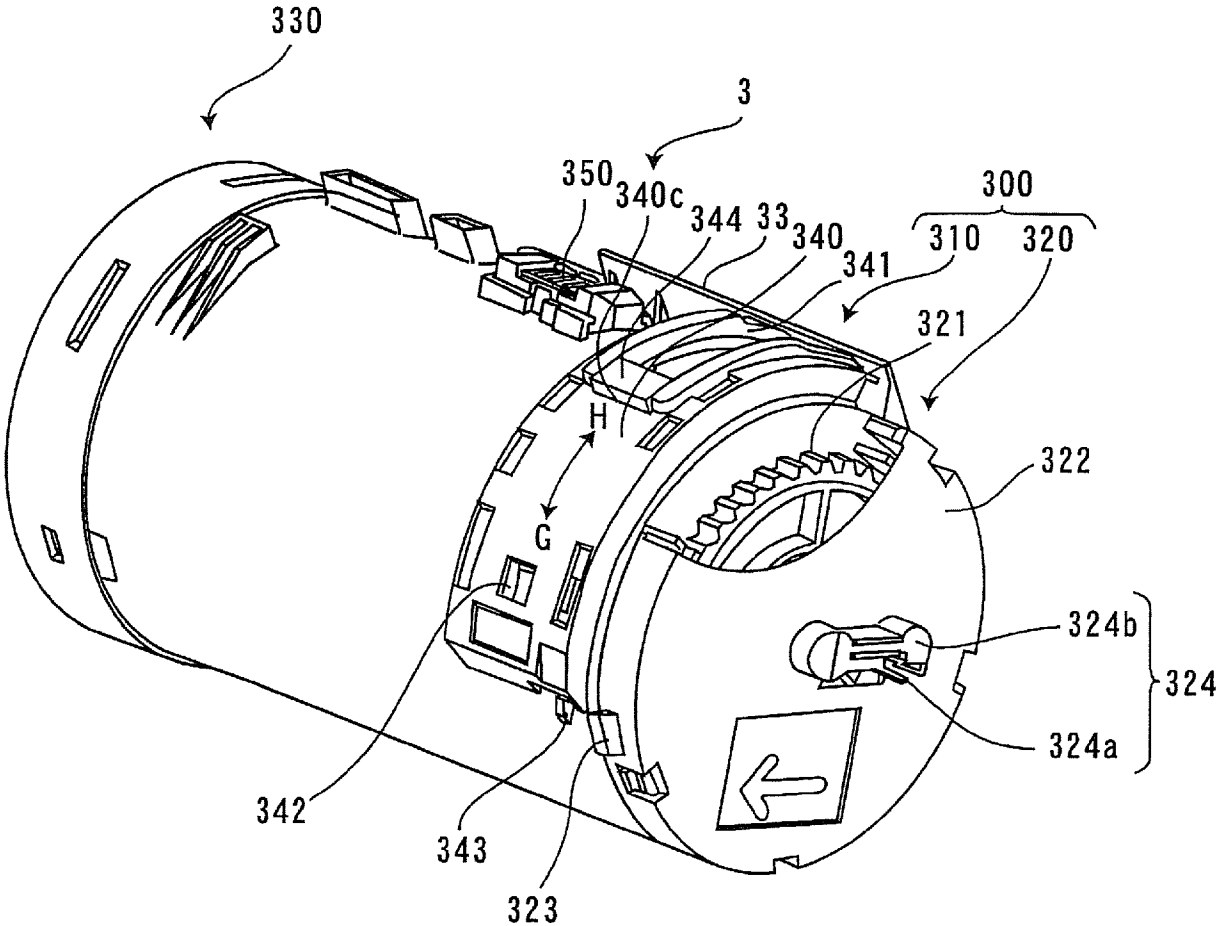
FIG. 7 is a perspective view illustrating an appearance of the toner cartridge as the single body, when viewed from a direction different from that of FIG. 6.

FIGS. 6 and 7 are perspective views illustrating an appearance of the toner cartridge as the single body, when viewed from directions different from each other.

The toner cartridge 3 has a body 310 having a cylindrical inner peripheral surface and an outer peripheral surface which is substantially cylindrical as a whole, and a pair of walls 320 and 330 blocking one end in a longitudinal direction of the substantially cylindrical shape, and an opposite end, respectively. The toner cartridge 3 accommodates the powder toner therein. Here, the first wall 320 blocking the one end forms a container body 300 receiving the toner therein together with the body 310 while the opposite end is opened. The second wall 330 blocking the opening 301 (see FIGS. 16A to 16D) of the container body 300 is a cover blocking the opening 301 after the toner is accommodated in the container body 300.

As shown in FIG. 1, the toner cartridge 3 is mounted to the process cartridge 2 mounted to the printer body 11 in a posture in which a longitudinal direction of the substantially cylindrical shape of the body 310 is a transverse direction.

As described above, a structural body where the process cartridge 2 excluding the toner cartridge 3 is mounted in the printer body 11 is referred to as 'an apparatus' herein.

The above-mentioned knob 32 is a portion which is gripped for the attachment/detachment of the body 310 to/from the apparatus, and as shown in FIGS. 1, 4, and 5, is installed on an outer peripheral surface of the body 310 at a rear end portion of the apparatus in the mounting direction in a posture in which the body 310 is mounted to the apparatus.

As described above, the shield 33 extends from a lower part of the knob 32 in a posture where the toner cartridge 3 is mounted to the apparatus to a location close to the bottom surface 28 (see FIGS. 4 and 5) of the inner wall surfaces defining the space of the apparatus for receiving the toner cartridge 3.

A shutter 340 is attached to the body 310. The opening 310*a* (see FIGS. 8 and 9) for supplying the toner accommodated in the toner cartridge 3 to the apparatus is formed at a location of the body 310 which is covered by the shutter 340, and the shutter 340 covers the opening 310*a* so that the opening 310*a* is openable and closable.

As shown in FIGS. 6 and 7, the shutter 340 is situated at a closed location where the opening 310*a* is blocked when the toner cartridge 3 is not mounted to the apparatus. When the toner cartridge 3 is mounted to the apparatus, by rotating the fixing member 26, a window 341 formed in the shutter 340 is moved to an opened location overlapping the opening 310*a* in a direction of arrow G, that is, in a direction perpendicular to a longitudinal direction of the body 310 along an outer peripheral surface of the body 310, thereby opening the opening 310*a* of the body 310. If the toner cartridge 3 is mounted, a boss (will be described below) of the fixing member 26 is inserted into a recess 342 of the shutter 340, and the shutter 340 receives a force from the fixing member 26 through a manipulation of rotating the fixing member 26 in the direction of arrow F of FIG. 1 and is moved to the opened location in the direction of arrow G. If the fixing member 26 is manipulated in the direction of arrow E, the shutter 340 receives a force from the fixing member 26 and is moved to the closed location in the direction of arrow E.

A movement blocking hook 343 is installed at a location which corresponds to a front end of the shutter 340 at the closed location as shown in FIGS. 6 and 7, and is the front side than the front end of the shutter 340 at the closed location in a movement direction (of arrow G) from the closed location to the opened location. The movement blocking hook 343 protrudes from the outer peripheral surface of the body 310 in a direction perpendicular to the longitudinal direction of the toner cartridge 3. When the shutter 340 is situated at the closed location, the movement blocking hook 343 interferes with the front end of the shutter 340, and when the toner cartridge 3 is a single body and is not mounted to the apparatus, the movement blocking hook 343 prevents the shutter 340 from being moved from the closed location toward the opened location while serving to stop the shutter 340 at the closed location. If the toner cartridge 3 is mounted to the apparatus, the toner cartridge 3 is pressed by a member of the apparatus and is resiliently deformed and pushed down to a height allowing a movement of the shutter 340 toward the opened location. A resilient body (a sponge 344 in the present embodiment) is installed at a location with which a corner 340*c* of the shutter 340 at the closed location collides. The details thereof will be described below.

A circuit board 350 is disposed on an outer peripheral surface of the body 310 of the toner cartridge 3 in a location parallel to the shutter 340 with respect to a longitudinal direction of the body 310, and the above-mentioned shield 33 is spread out to a location close to the shutter 340 or the circuit board 350. Various data containing, for example, manufacture information of the toner cartridge 3 or consumption of the toner are stored in the circuit board 350.

A gear 321 is installed in the first wall 320 of the toner cartridge 3 constituting the container body 300 together with the body 310, and a cap 322 covers the gear 321 while partially exposing the gear 321. The gear 321 serves to transfer a driving force of the motor 111 shown in FIG. 1 to the agitation member 31 (see FIG. 1) within the toner cartridge 3 and rotate the agitation member 31. Meanwhile, a rotation center axis direction of the agitation member 31 is sometimes referred to simply as a rotation center axis direction.

A boss 323 and a locker 324 are formed in the cap 322.

As shown in FIG. 7, an arrow is marked in the cap 322, by which a mounting direction of the toner cartridge 3 can be viewed by a user.

The boss 323 serves to prevent the shutter 340 from being inclined so that the toner flows down as a corner of the shutter 340 receives an impact when the toner cartridge 3 is carelessly dropped while being discarded, and prevent the shutter 340 from being moved in the opening direction as the movement blocking hook 343 is pushed down due to the impact.

The boss 323 collides with the fixing member 26 (see FIG. 1) of the apparatus when the toner cartridge 3 is mounted to the apparatus and the shutter 340 is moved to an opened location to serve as a stopper for restraining the shutter 340 from moving further. The details of the boss 323 will be described below.

The locker 324 has a first locking portion 324*a* and a second locking portion 324*b*, and serves to prevent the toner cartridge 3 from being withdrawn from the apparatus when the toner cartridge 3 is mounted to the apparatus. Even though a locker also exists in the second wall (cover) 330, the shape thereof is different from that of the first wall 320. The details of the locker will also be described below.

The entire configuration has been described until now, and the characteristic configurations of the parts of the present exemplary embodiment will be described.

(Agitation Member)

Hereinafter, the agitation member 31 (see FIG. 1) disposed within the toner cartridge 3 to agitate the toner in the toner cartridge 3 will be described.

Figure 8:
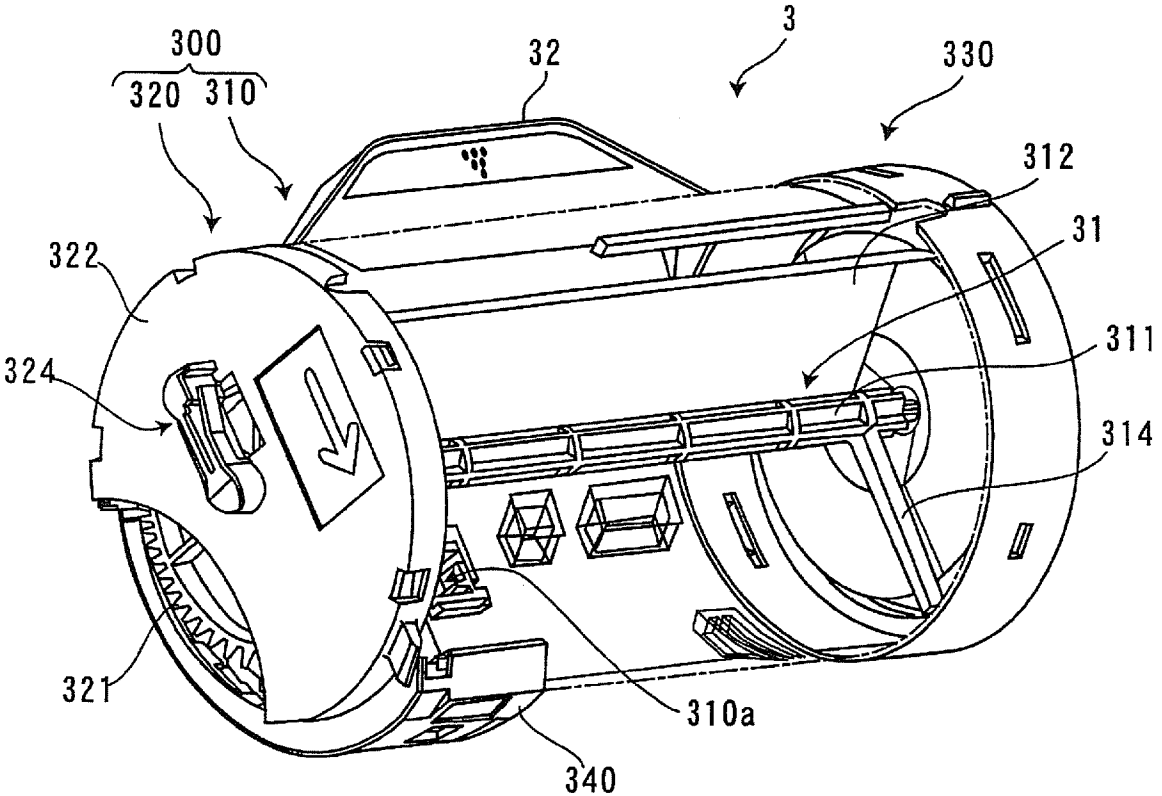
FIG. 8 is a view illustrating an agitation member within the toner cartridge whose body is semitransparent.

FIG. 8 is a view illustrating the agitation member within the toner cartridge whose body is semitransparent.

Figure 9:
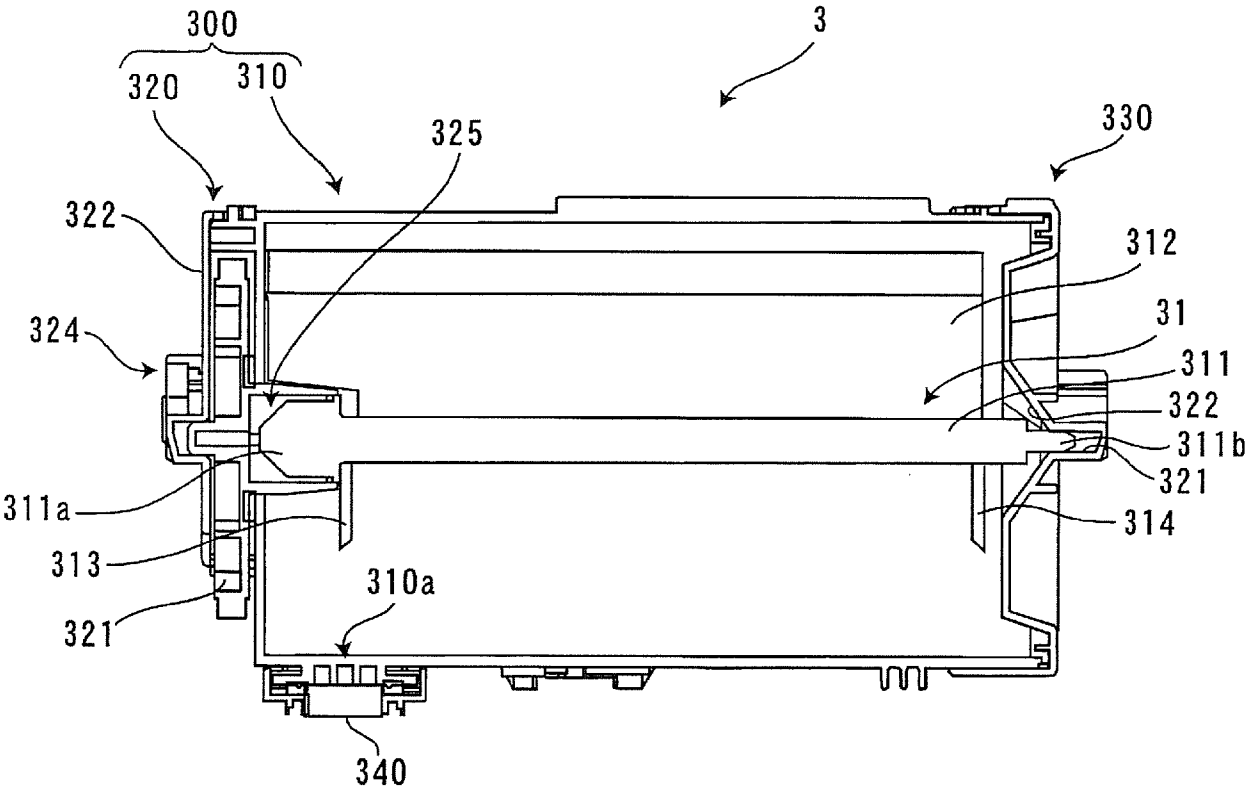
FIG. 9 is a sectional view illustrating the toner cartridge, taken along a plane including the agitation member.

FIG. 9 is a sectional view illustrating the toner cartridge, taken along a plane including the agitation member.

As shown in FIGS. 8 and 9, the agitation member 31 is installed within the toner cartridge 3.

Here, a structure of the agitation member 31 itself will be described, in which case FIGS. 8 and 9 will be referenced if necessary.

Figure 10:
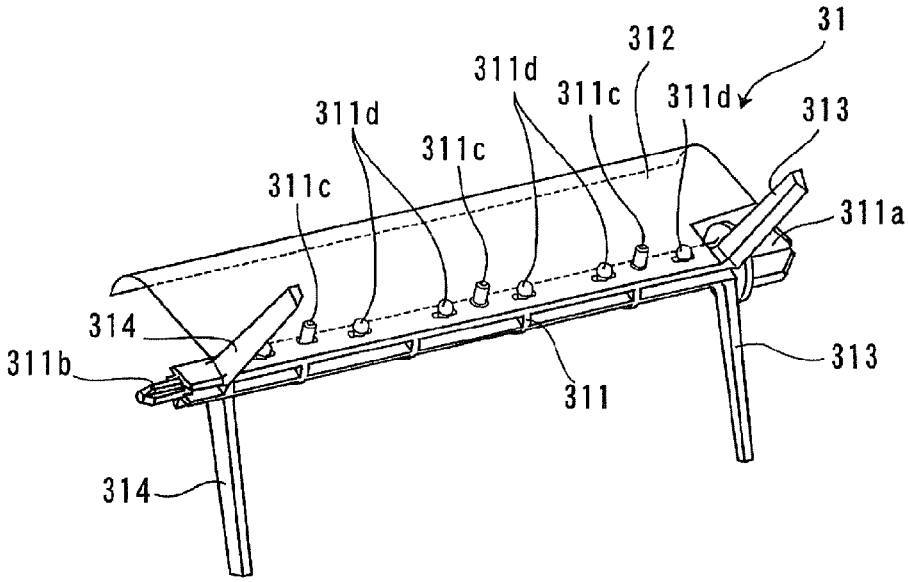
FIG. 10 is a perspective view of the agitation member.
Figure 11:
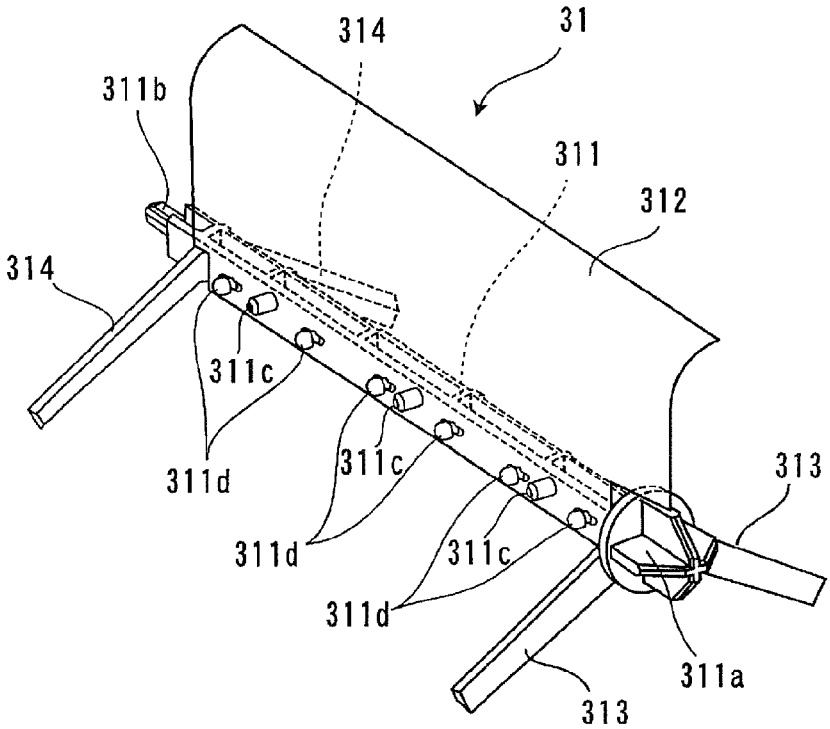
FIG. 11 is a perspective view of the agitation member, when viewed from a view point different from that of FIG. 10.

FIGS. 10 and 11 are perspective views of the agitation member when viewed separately.

The agitation member 31 has a shaft member 311, a sheet member 312, a plurality of first arm members 313 (two first arm members in the present exemplary embodiment), and a plurality of second arm members 314 (two second arm members in the present exemplary embodiment).

As shown in FIGS. 8 and 9, the shaft member 311 is a member extending along a center axis of an inner peripheral surface of the body 310, and has a driving force accommodating portion 311*a* for receiving a driving force from the outside at an end of the shaft member 311 at the first wall 320 side. The shaft member 311 also has a supporting/accommodating portion 311*b* freely rotatably supported by the second wall (cover) 330 at an end of the shaft member 311 at the second wall (cover) 330 side. The shaft member 311 receives a driving force through the driving force accommodating portion 311*a* to be rotated.

The sheet member 312 constituting the agitation member 31 is a flexible plastic film spread out in a direction from one wall 320 of the body 310 toward another wall (cover) 330 along the shaft member 311 to be supported by the shaft member 311. The sheet member 312 is also spread out in a radial direction from the shaft member 311 toward the inner peripheral surface of the body 310, and is rotated as the shaft member 311 rotates, thereby agitating the toner accommodated in the toner cartridge 3. The sheet member 312 is formed longer than a distance from the shaft member 311 to the inner peripheral surface of the body 310 so as to always contact the inner peripheral surface of the body 310 when the shaft member 311 is rotated. FIGS. 10 and 11 where a tip radial portion of the sheet member 312 is curved shows that the tip portion of the sheet member 312 is rotated while contacting the inner peripheral surface of the body 310, resulting in a shown curve.

A portion of the shaft member 311 supporting the sheet member 312 corresponds to a plane, and a positioning boss 311*c* and a fixing boss 311*d* are installed on the plane. A hole is formed at a location of the sheet member 312 corresponding to the bosses 311*c* and 311*d*, and the positioning boss 311*c* is inserted into the sheet member 312 to position the sheet member 312 and the fixing boss 311*d* is inserted into the sheet member 312 to fix the sheet member 312 to the shaft member 311.

The first arm member 313 is a member extending from the shaft member 311 toward the inner peripheral surface of the body 310 at a location closer to the first wall 320 than a longitudinal center of the shaft member 311 and configured to be rotated integrally with the shaft member 311. In the present exemplary embodiment, either of the first arm member 313 and the second arm member 314 to be described below is formed with one resin part integrally formed with the shaft member 311.

The plurality of first arm members 313 extend from a direction different from a direction which the front end of the sheet member 312 faces and also extend different directions from each other with respect to a rotating direction of the shaft member 311. In detail, in the present exemplary embodiment, the sheet member 312 and the two first arm members 313 are formed radially in directions spaced apart from each other by 120 degree with respect to the rotating direction of the shaft member 311.

The second arm member 314 is a member extending from the shaft member 311 toward the inner peripheral surface of the body 310 at a location closer to the second wall (cover) 330 than a longitudinal center of the shaft member 311 and configured to be rotated integrally with the shaft member 311.

As described above, in the present exemplary embodiment, as in the first arm member 313, the second arm member 314 is a part integrally formed with the shaft member 311.

The plurality of second arm members 314 extend along a direction different from a direction where the front end of the sheet member 312 faces and also different from a rotating direction of the shaft member 311. In detail, in the present exemplary embodiment, the two second arm members 314 extend in the same directions as the two first arm members 313, respectively. That is, the sheet member 312 and the two second arm members 314 are formed radially in directions spaced apart from each other by 120 degree with respect to the rotating direction of the shaft member 311.

Meanwhile, the lengths of the first arm member 313 and the second arm member 314 are shorter than a distance from the shaft member 311 to the inner peripheral surface of the body 310.

Figure 12:
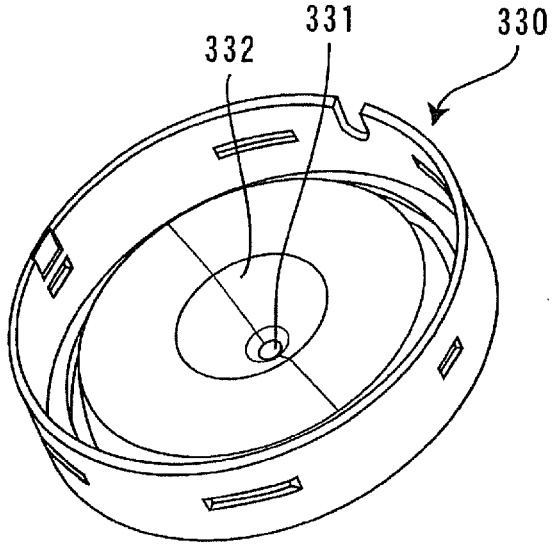
FIG. 12 is a perspective view of a cover constituting second wall of the toner cartridge, when viewed from an inner surface thereof.

FIG. 12 is a perspective view of a cover constituting the second wall of the toner cartridge, when viewed from an inner surface thereof.

The cover is a member which covers the container body 300 to form the second wall 330 (see FIGS. 6 to 9) after the agitation member 31 is inserted into the container body 300 of the toner cartridge 3 from the opening 301 and the toner is filled from the opening 301. A support hole 331 as an example of a support portion for freely rotatably supporting the supporting/accommodating portion 311*b* of the shaft member 311 constituting the agitation member 31 is formed at a center of the inner surface of the cover. A conically inclined guide surface 332 for guiding the supporting/accommodating portion 311*b* of the shaft member 311 to the support hole 331 is formed at a circumference of the support hole 331 to be recessed toward the support hole 331.

Meanwhile, as shown in FIG. 9, a driving force transferring mechanism 325 for transferring a driving force transferred to the gear 321 to the driving force accommodating portion 311*a* of the shaft member 311 is installed on the first wall 320.

The agitation member 31 is inserted into and installed within the container body 300 whose second wall (cover) 330 is opened in a direction in which the driving force accommodating portion 311*a* of the shaft member 311 is engaged with the driving force transferring mechanism 325.

In a state where the agitation member 31 is installed within the container body 300, as the sheet member 312 contacts the inner peripheral surface of the body 310, the shaft member 311 receives a force in a direction far away from the center of the body 310. Then, the second arm member 314 supports the shaft member 311 lest the shaft member 311 should fall down from the center of the substantially cylindrical shape of the body 311 to a high degree. In more detail, in a state where the second arm member 314 and the inner peripheral surface of the body 310 contact each other, the supporting/accommodating portion 311*b* is located within a diameter of the inclined guide surface 332. If the second wall (cover) 330 is mounted in this state, the supporting/accommodating portion 311*b* of the shaft member 311 is guided by the inclined guide surface 332 to enter the support hole 331, and thus become freely rotatably supported by the support hole 331. The agitation member 31 receives a driving force transferred through the gear 321 to the driving force accommodating portion 311*a* to be rotated, and agitates the interior toner. Then, the first arm member 313 and the second arm member 314 are rotated integrally with the shaft member 311. Meanwhile, since the lengths of the first arm member 313 and the second arm member 314 are shorter than a distance from the shaft member 311 to the inner peripheral surface of the body 310, none of the first arm member 313 and the second arm member 314 contacts the inner peripheral surface of the body 310(while the shaft member 311 rotates. Here, the toner cartridge 3 is mounted to the apparatus in a posture where a longitudinal direction thereof is a transverse direction to be used in the apparatus in the posture, but may sometimes be in a posture where the longitudinal direction of the toner cartridge 3 is a longitudinal direction, when the toner cartridge 3 is a single body, for example, when the toner cartridge 3 is conveyed or kept. In this case, the interior toner may be pressed downward to cohere. In the present exemplary embodiment, since the first arm member 313 and the second arm member 314 are installed at a location close to the first wall 320 and the second wall 330, the cohered toner is collapsed by one of the first arm member 313 and the second arm member 314 where the toner is cohered if the agitation member 31 is rotated when the toner starts to be used.

As shown in FIG. 8, in the body 310 constituting the body container 300, an opening 310*a* for supplying the interior toner toward the apparatus is formed at a location below the shaft member 311 in a posture where the container body 300 is mounted to the apparatus, and the opening 310*a* is blocked by the shutter 340. Here, as shown in FIG. 9, a fixed location of the first arm member 313 to the shaft member 311 is predetermined to pass by a location facing the opening 310*a* when the agitation member 31 is rotated. As the first arm member 313 passes by the location facing the opening 310*a*, the cohered toner is prevented from staying in the vicinity of the opening 310*a*. Meanwhile, in the present exemplary embodiment, the first arm member 313 extends from the same location of the shaft member 311 with respect to a longitudinal direction of the shaft member 311. Accordingly, both the two first arm member 313 passes by a location facing the opening 310*a*. In this case, the two first arm members 313 may extend from separate locations with respect to the longitudinal direction of the shaft member 311, such that only one of the first arm members 313 may pass by the location facing the opening 310*a*.

Meanwhile, herein, the arm members are installed at opposite ends of the shaft member 311, but may be installed not at the opposite ends of the shaft member 311 but, for example, in the vicinity of the center of the shaft member 311 and support the shaft member 311 lest the shaft member 311 should fall down to a high degree during the assembly thereof.

Figure 13:
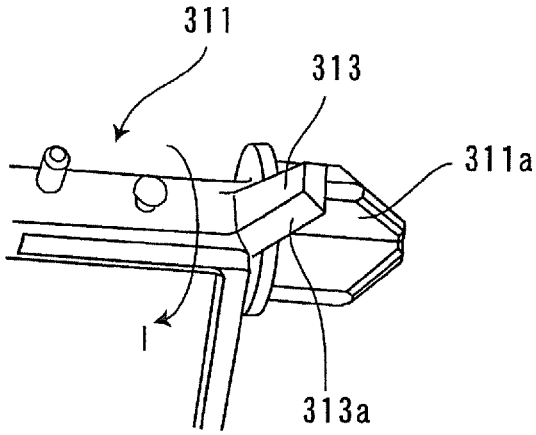
FIG. 13 is a partially enlarged perspective view of a driving force receiving part of a resin molded product constituting the agitation member.
Figure 14:
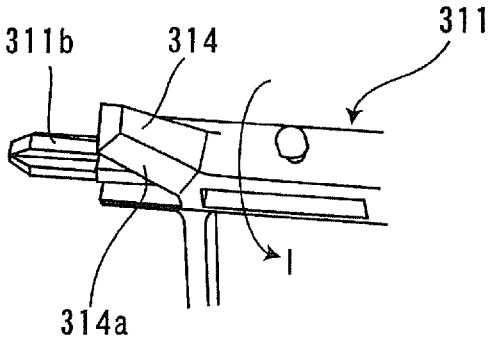
FIG. 14 is a partially enlarged perspective view of a supported part of the resin molded product constituting the agitation member.

FIGS. 13 and 14 are partially enlarged perspective views of the driving force receiving part and supported part of resin molded products constituting the agitation member, respectively.

Arrow I of FIGS. 13 and 14 denotes a rotating direction of the shaft member 311.

As shown in FIGS. 13 and 14, the first arm member 313 and the second arm member 314 have inclined surfaces 313*a* and 314*a*, respectively. The inclined surfaces 313*a* and 314*a* generate partial forces pressing the interfered toner to a vicinity of the center of the shaft member 311 in the rotating center line direction when rotated in the direction of the arrow I. As described above, if the toner cartridge 3 is laid in a posture where the rotation center axis extends longitudinally, the interior toner may be pressed downward to show a sign to cohere. If the inclined surfaces 313*a* and 314*a* are formed in the first arm member 313 and the second arm member 314, a partial force pressing the toner toward a direction in which the toner which shows a sign to cohere during the rotation of the agitation member 31 becomes far away from the end, that is, to the vicinity of the center in the direction of the rotation center axis of the shaft member 311 is generated, moving the toner to the vicinity of the center of the shaft member 311. A rotating torque of the shaft member 311 is reduced as compared with the case where the toner is agitated by an arm member without any inclined surface.

Meanwhile, in the present exemplary embodiment, even though the inclined surfaces 313*a* and 314*a* are formed in all of the two first arm members 313 and the two second arm members 314, inclined surfaces may be formed in only one of the two first arm members 313 and only one of the two second arm members 314.

Figure 15:
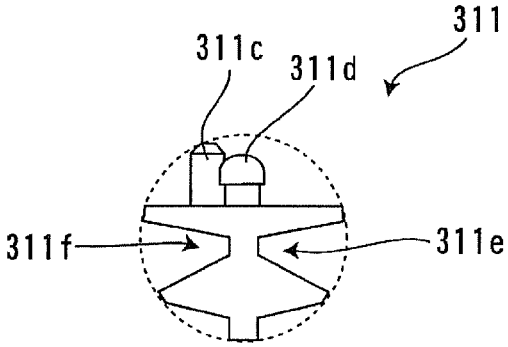
FIG. 15 is a view illustrating a shaft member constituting the agitation member, taken along a plane whose perpendicular corresponds to a direction in which the shaft member extends.

FIG. 15 is a view illustrating the shaft member constituting the agitation member, taken along a plane whose perpendicular corresponds to a direction in which the shaft member extends.

The shaft member 311 has recesses 311*e* and 311*f* to reduce materials and make weight light. The recesses 311*e* and 311*f* have a shape which becomes narrower as it goes to a vicinity of the center axis of the shaft member 311 and becomes opened wider as it goes to the outside of the shaft member 311. This shape is also designed to prevent the toner from cohering. That is, even when the toner having entered the recesses 311*e* and 311*f* shows a sign to cohere, since the recesses 311*e* and 311*f* have a shape which becomes opened wider as it becomes farther away from the shaft center, the toner in the recesses 311*e* and 311*f* is apt to be moved outward while restraining the recesses 311*e* and 311*f* from being filled with the cohered toner.

FIGS. 16A to 16D are schematic diagrams illustrating a toner cartridge assembling process. However, a process of charging the toner is omitted herein.

Figure 16A:
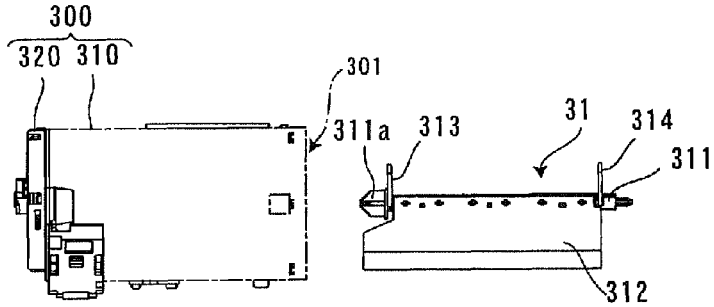
FIGS. 16A to 16D are schematic diagrams illustrating an assembly process for the toner cartridge.
Figure 16B:
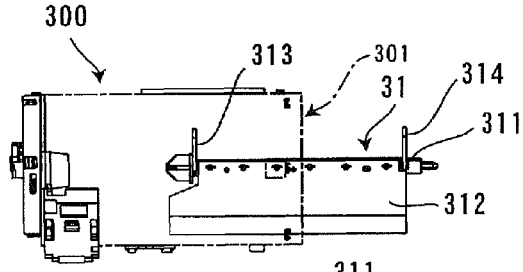

In assembling the toner cartridge, the agitation member 31 including the body 310 and the first wall 320 blocking one end thereof is inserted into the container body 300 from the opening 301 at one end, starting from the driving force accommodating portion 311*a* of the shaft member 311 (FIGS. 16A and 16B)

Figures 1, 16C:
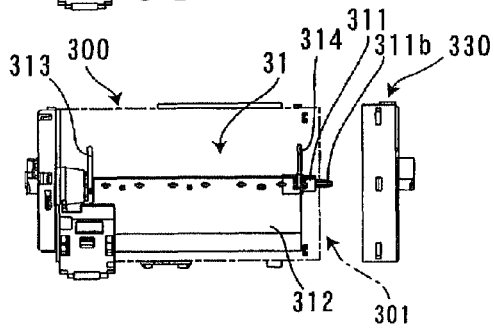
Figures 2, 16C:
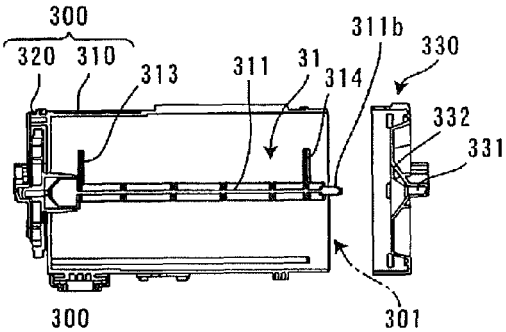
Figure 16D:
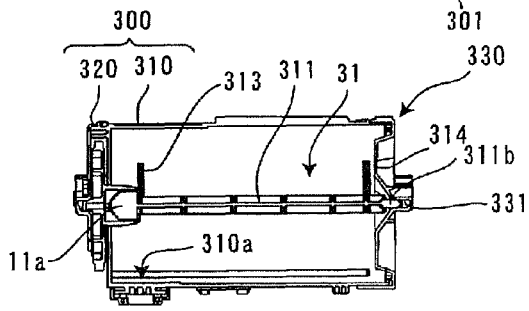

Even though only one end of the shaft member 311 on a driving force accommodating portion 311*a* side is supported and the supporting/accommodating portion 311*b* is not supported in a state where the agitation member 31 is inserted into the container body 300, the supporting/accommodating portion 311*b* of the shaft member 311 is maintained in a vicinity of the center of the body 310 by the operations of the sheet member 312 and the second arm member 314 (FIGS. 16C-1 and 16C-2). Meanwhile, as in FIGS. 16A and 16B, FIG. 16C-1 is a view illustrating the body 310 being transparent, and FIG. 16C-2 is a sectional view in the same state of FIG. 16C-1. Thus, when the second wall (cover) 330 is mounted, the supporting/accommodating portion 311*b* is guided by the inclined guide surface 332 of the second wall (cover) 330 to enter the support hole 331 while being supported freely rotatably.

Figure 17:
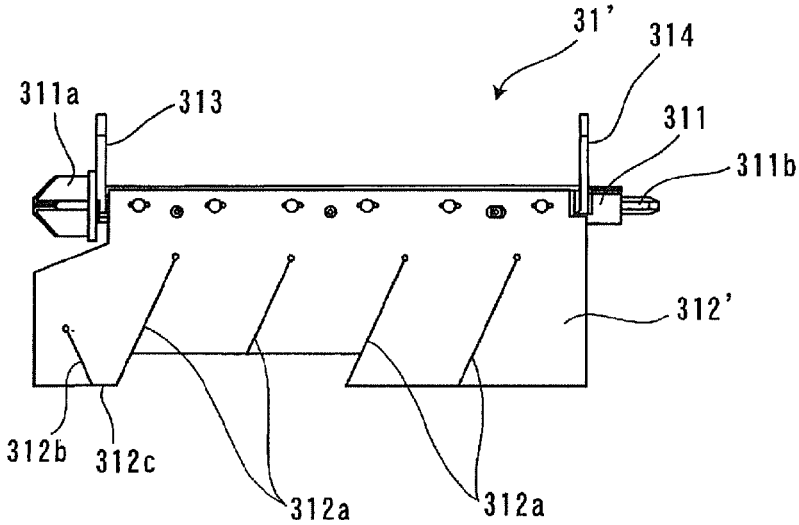
FIG. 17 is a view illustrating a modification of the agitation member.

FIG. 17 is a view illustrating a modification of the agitation member.

A difference between the agitation member 31' shown in FIG. 17 and the agitation member 31 described until now lies in the sheet member 312'.

An oblique cutting line 312*a* is formed in the sheet member 312'. By forming the cutting line 312*a* in a direction shown in the drawing, a force moving the toner from the supporting/accommodating portion 311*b* toward the driving force accommodating portion 311*a* is generated when the agitation member 31' is rotated with the shaft member 311 being transversely. Due to this, in the present exemplary embodiment, since the opening 310*a* (see FIG. 8) for supplying the toner to the apparatus is formed on the driving force accommodating portion 311*a* side, the toner is moved toward the opening 310*a*.

The sheet member 312' is long on the supporting/accommodating portion 311*b* side and becomes shorter to a degree at an intermediate location with respect to a length (a length in a direction far away from the shaft member 311) of the body 310 in a direction facing the inner peripheral surface of the body 310. This helps the toner on the supporting/accommodating portion 311*b* side move toward the opening 310*a* (see FIG. 8) more strongly.

The sheet member 312' has a cutting line 312*b* formed obliquely opposite to the cutting line 312*a*, and accordingly, an apex portion 312*c* opposite sides of which are cut to have a substantially triangular shape is formed in the driving force accommodating portion 311*a* side. The apex portion 312*c* is formed at the same location as the first arm member 313 with respect to a longitudinal direction of the shaft member 311. As in the above-described embodiment, the first arm member 313 passes by a location facing the toner supplying opening 310*a* to be rotated. Thus, the apex portion 312*c* of the sheet member 312' also passes through the opening 310*a*. The sheet member 312' has length by which the sheet member 312' is rotated while contacting the inner peripheral surface of the body 310, and accordingly, the apex portion 312*c* passes through the opening 310*a* in a fashion where the apex portion 312*c* enters into the opening 310*a*. If the apex portion 312*c* is formed, a force for pushing the toner inside the opening 310*a* out from the opening 310*a* is applied.

(Boss)

As shown in FIG. 7 which has been described above, the boss 323 is formed in a cap 322 constituting an outer wall surface of the first wall 320.

Figure 18:
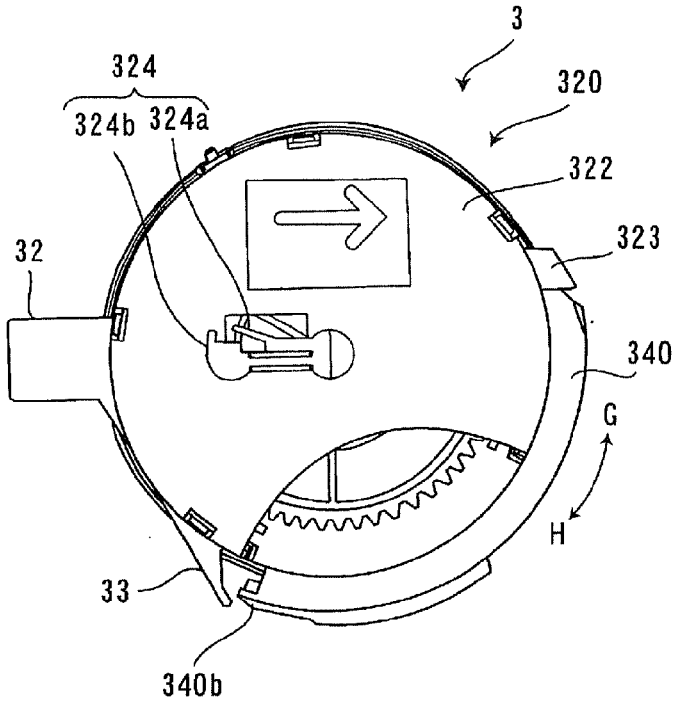
FIG. 18 is a side view of a boss, when viewed from a first wall along a rotation center axis.
Figure 19:
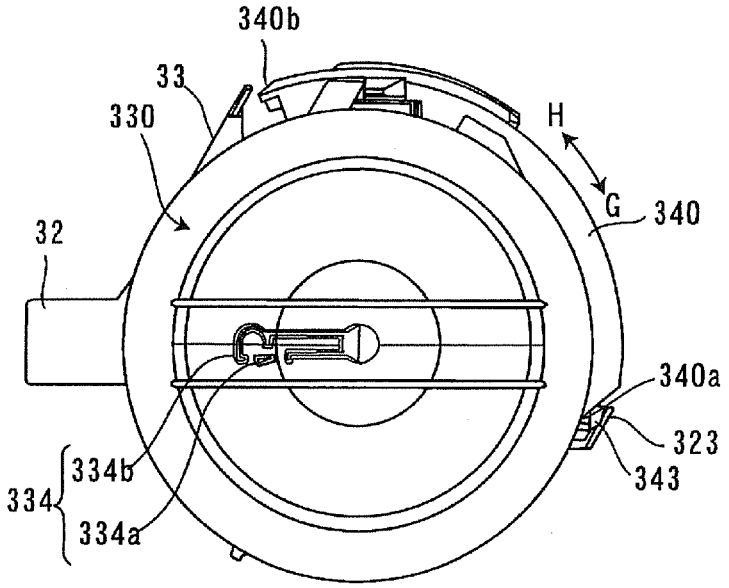
FIG. 19 is a side view of the boss, when viewed from the second wall (cover) along the rotation center axis.

FIG. 18 is a side view of the boss 323, when viewed from the first wall along a rotation center axis. FIG. 19 is a side view of the boss 323, when viewed from the second wall (cover) along a rotation center axis.

Figure 20:
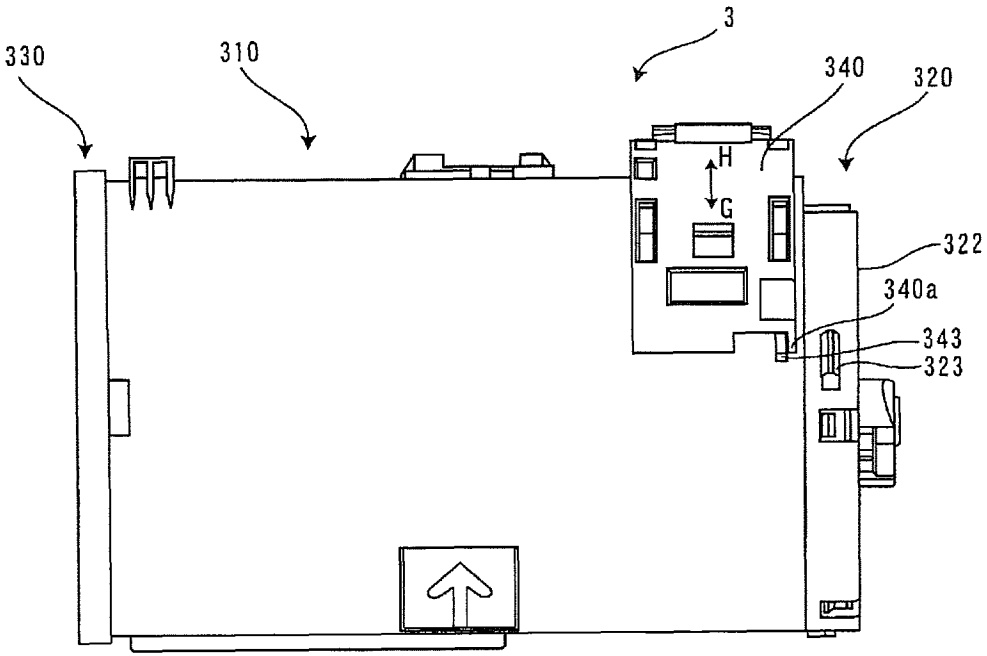
FIG. 20 is a plan view of the boss, when viewed from a front end of the boss.

FIG. 20 is a plan view of the boss 323, when viewed from a front end of the boss. As shown in FIGS. 7 and 20, the boss 323 is situated at a location between the shutter 340 and the outer wall surface of the first wall 320 with respect to a longitudinal direction of the substantially cylindrical body 310 and parallel to the front end in the movement direction (a direction of arrow G) facing the opened location of the shutter 340 at the closed location with respect to the rotating direction about the rotation center being the shaft member 311. As can be seen from FIG. 19, the boss 323 has a rotational width also parallel to the above-described movement blocking hook 343 together with the front end of the shutter 340. As can be seen from FIGS. 18 and 19, the boss 323 protrudes to the radially outward direction higher than the movement blocking hook 343 with respect to the radial direction from the rotation center axis of the body 310.

While it is difficult to leak the interior toner when the entire shutter 340 is pressed from the outer surface thereof, a portion of the shutter 340 distant from a corner portion of the shutter 340 may show a sign to float if the corner portion of the shutter 340 is pressed, causing the interior toner to be leaked therefrom.

Here, the boss 323 is formed in the vicinity of the corner portion 340*a* of the shutter 340, and when the toner cartridge 3 drops while the corner portion 340*a* of the shutter 340 faces downward, the boss 323 receives an impact due to the drop lest the portion of the shutter 340 distant from the corner portion 340*a* should float as the corner portion 340*a* of the shutter 340 is pressed.

The movement blocking hook 343 serves to leave the shutter 340 at a closed location when the toner cartridge 3 is a single body, and serves to allow movement of the shutter 340 as the movement blocking hook 343 is pressed toward the radially inner side when mounted to the apparatus. Thus, for example, if the movement blocking hook 343 is pressed due to a drop, the shutter 340 turns into a state where the shutter 340 can be moved toward the opened location, and the shutter 340 is moved toward the opened location to a degree by a drop impact, and the like, possibly causing the toner exiting from the opening 310*a* (see FIG. 8 and FIGS. 16A to 16D) of the body 310 to be leaked.

The boss 323 according to the present exemplary embodiment prevents the movement blocking hook 343 from being pressed due to a drop impact, and the like in relation to the movement blocking hook 343.

After the toner cartridge 3 is mounted to the apparatus, the shutter 340 is moved from the closed location to the opened location due to rotation of the fixing member 26 (see FIG. 1) of the apparatus in the direction of arrow F. When the shutter 340 is moved to the opened location, the boss 323 collides with the fixing member 26 of the apparatus, serving as a stopper for blocking a further movement of the shutter 340 in a direction where the shutter 340 is further opened. This aspect will be described below.

As shown in FIGS. 7 and 8, the locker 324 having the first locking portion 324*a* and the second locking portion 324*b* is formed in the cap 322 constituting the first wall 320. Likewise, as shown in FIG. 19, a locker 334 having a first locking portion 334*a* and a second locking portion 334*b* is also formed in the second wall (cover) 330.

The first locking portion 324*a* of the first wall 320 has a cantilever-shaped shape extending along an outer surface of the cap 322, that is, a plane crossing the rotation center axis, and the first locker portion 334*a* of the second wall (cover) 330 has a cantilever-shape protruding in a direction parallel to the rotation center axis from the second wall (cover) 330. The details of the lockers 324 and 334 will be described below.

(Shield)

As shown in FIGS. 4 to 7, the shield 33 is formed in the body 310 of the toner cartridge 3.

The shield 33 forms a plane forming a portion of the outer surface of the body 310 below the knob 32 in a posture where the shield 33 is mounted to the apparatus (see FIGS. 4 and 5). The shield 33 is formed on a plane to be easily formed of a resin.

The shield 33 is spread out to a location of the shutter 340 in the closed location which is close to the end 340*b* (see FIGS. 7, 18, and 19) of the knob 32 side with respect to the rotating direction and higher than the end 340*b* of the knob 32 side of the shutter 340 with respect to a radial direction from the rotation center axis, forming a portion of the outer surface of the body 310. Thus, the shield 33 prevents an impact from being applied to the end 340*b* of the shutter 340 during a drop.

The shield 33 is spread out to both the location parallel to the shutter 340 and the location parallel to the circuit board 350 with respect to the rotation center axis direction. Accordingly, the shield 33 serves to divide a region which can be contacted by a hand of a user and a region where the shutter 340 or the circuit board 350 is disposed lest the hand gripping the knob 32 should carelessly contact the shutter 340 or the circuit board 350.

As described with reference to FIGS. 4 and 5, when the toner cartridge 3 is mounted to the apparatus, the shield 33 is spread out to a location close to the bottom surface 28 (see FIGS. 4 and 5) of the inner wall surfaces of the apparatus defining a space receiving the toner cartridge 3. Thus, if the toner cartridge 3 is mounted to the apparatus, the opening 310*a* or the circuit board 350 cannot be seen even if viewed by the user from the mounting direction of the toner cartridge 3, as the shield 33 shields between the outside of the apparatus and the circuit board 350. The circuit is prevented from being electrostatically damaged as a finger approaches the circuit board 350 and the like by preventing the finger from entering a gap between the shield 33 and the bottom surface 28.

(Shape of Opening)

Figure 21:
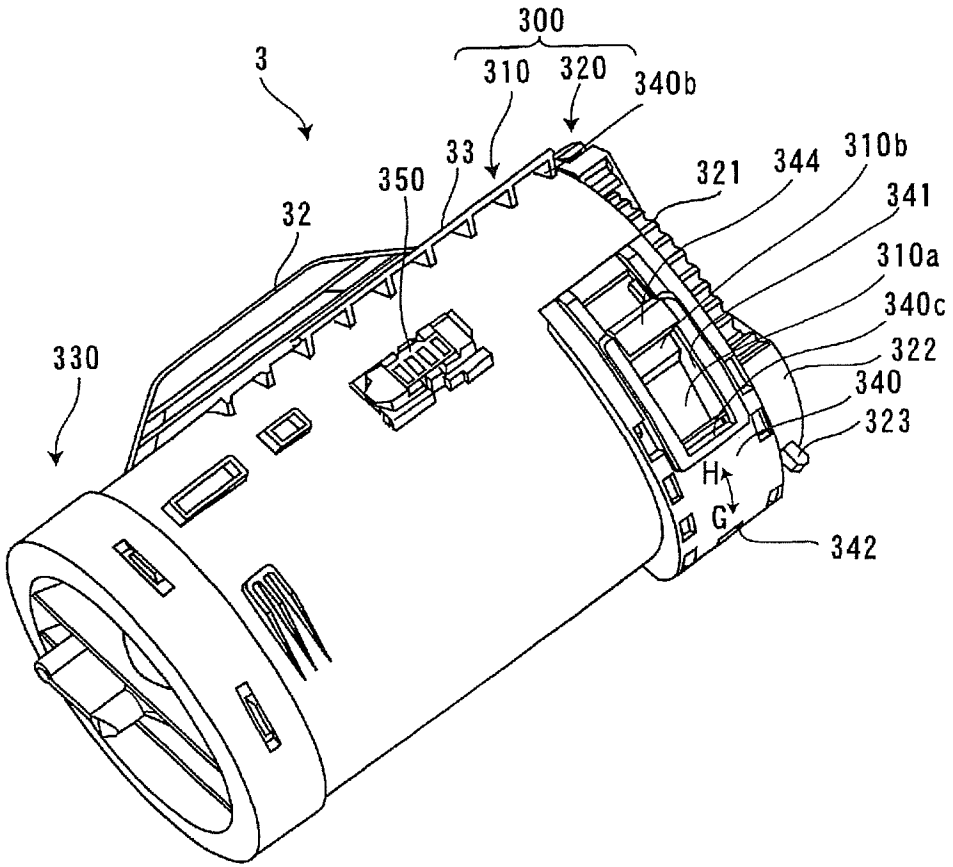
FIG. 21 is a perspective view of the toner cartridge when a shutter is in an opened location.

FIG. 21 is a perspective view of the toner cartridge when the shutter is in the opened location. The toner cartridge when the shutter is in the closed location is shown in FIG. 6.

Meanwhile, the shutter opening/closing mechanism will be described below, and it is considered that the shutter can be opened and closed.

Figure 22:
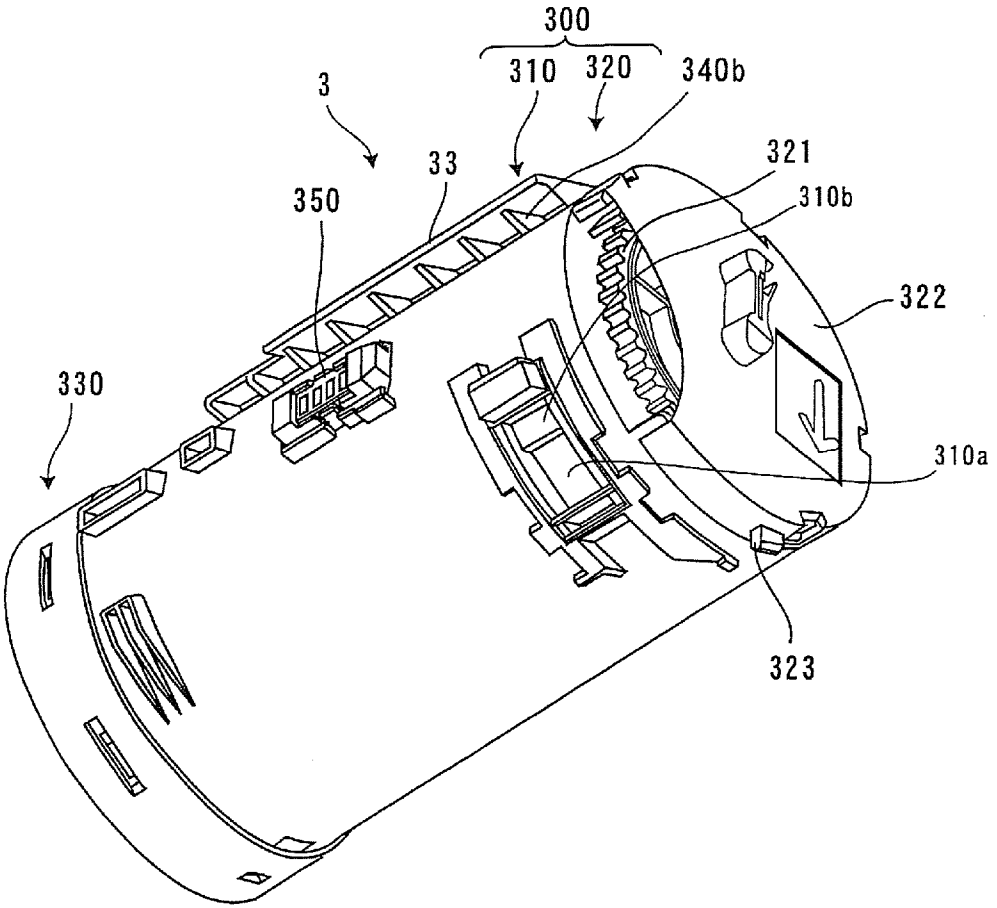
FIG. 22 is a perspective view illustrating a state where an opening portion of the body is exposed by removing the shutter itself from the toner cartridge.

FIG. 22 is a perspective view illustrating a state where an opening portion of the body is exposed by removing the shutter itself from the toner cartridge.

Figure 23:
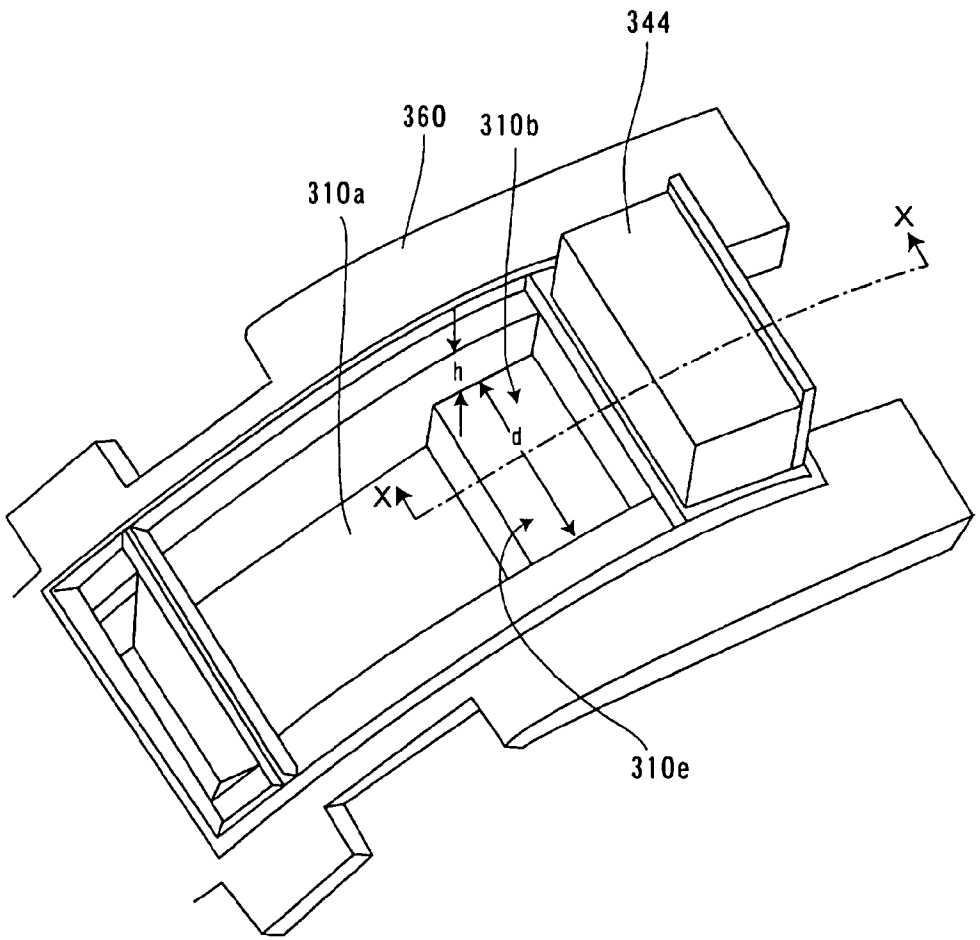
FIG. 23 is an enlarged perspective view of the opening portion formed in the body.
Figure 24:
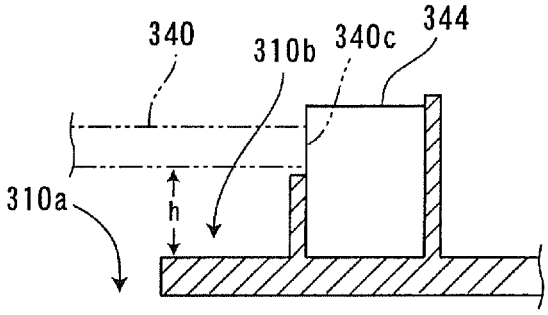
FIG. 24 is a sectional view taken along arrow X-X shown in FIG. 23.

FIG. 23 is an enlarged perspective view of the opening portion formed in the body. FIG. 24 is a sectional view taken along arrow X-X shown in FIG. 23.

As shown in FIG. 8, the opening 310*a* for supplying the toner inside the toner cartridge 3 to the apparatus is formed at a location of the body 310 of the toner cartridge 3 which is below the rotation center axis when the toner cartridge 3 is in a posture where the toner cartridge 3 is mounted to the apparatus and close to the first wall 320. A storage chamber 310*b* for storing the toner flowed in the movement direction thereof by the shutter 340 is formed in the body 310 on a front side in the movement direction (a direction of arrow H) in which the shutter 340 is moved from the opened location shown in FIG. 21 toward the closed location shown in FIG. 6 with respect to the opening 310*a*. The storage chamber 310*b* is covered by the shutter 340 having moved to the closed location.

In this way, by installing the storage chamber 310*b* at the location, even when the toner is flowed in the movement direction of the shutter 340 by the shutter 340 facing from the opened location to the closed location, the flowed toner is stored in the storage chamber 310*b*, and is prevented from being leaked to the outside.

As shown in FIG. 23, the storage chamber 310*b* has the same width d as that of the opening 310*a* with respect to the rotation center axis direction, and has a passage 310*e* opened over an entire width d in the rotation center axis direction and an entire radial height h of the storage chamber 310*b* from the rotation center axis in the movement direction of the shutter 340, between the storage chamber 310*b* and the opening 310*a*. Since the passage 310*e* is opened in this way, the toner is prevented from being moved toward the opening 310*a* and being overflowed to the outside even when the storage chamber 310*b* is fully filled with the toner.

Since a resilient member (a sponge 344 in the present exemplary embodiment) is disposed on a front side of the storage chamber 310*b* in the movement direction in which the shutter 340 is moved from the opened location toward the closed location, the resilient member 344 contacts the corner 340*c* of the shutter 340 having moved to the closed location. As the sponge 344 is disposed, the toner in the storage chamber 310*b* is prevented from being overflowed to the outside.

(Shutter Opening/Closing Mechanism)

Figure 25:
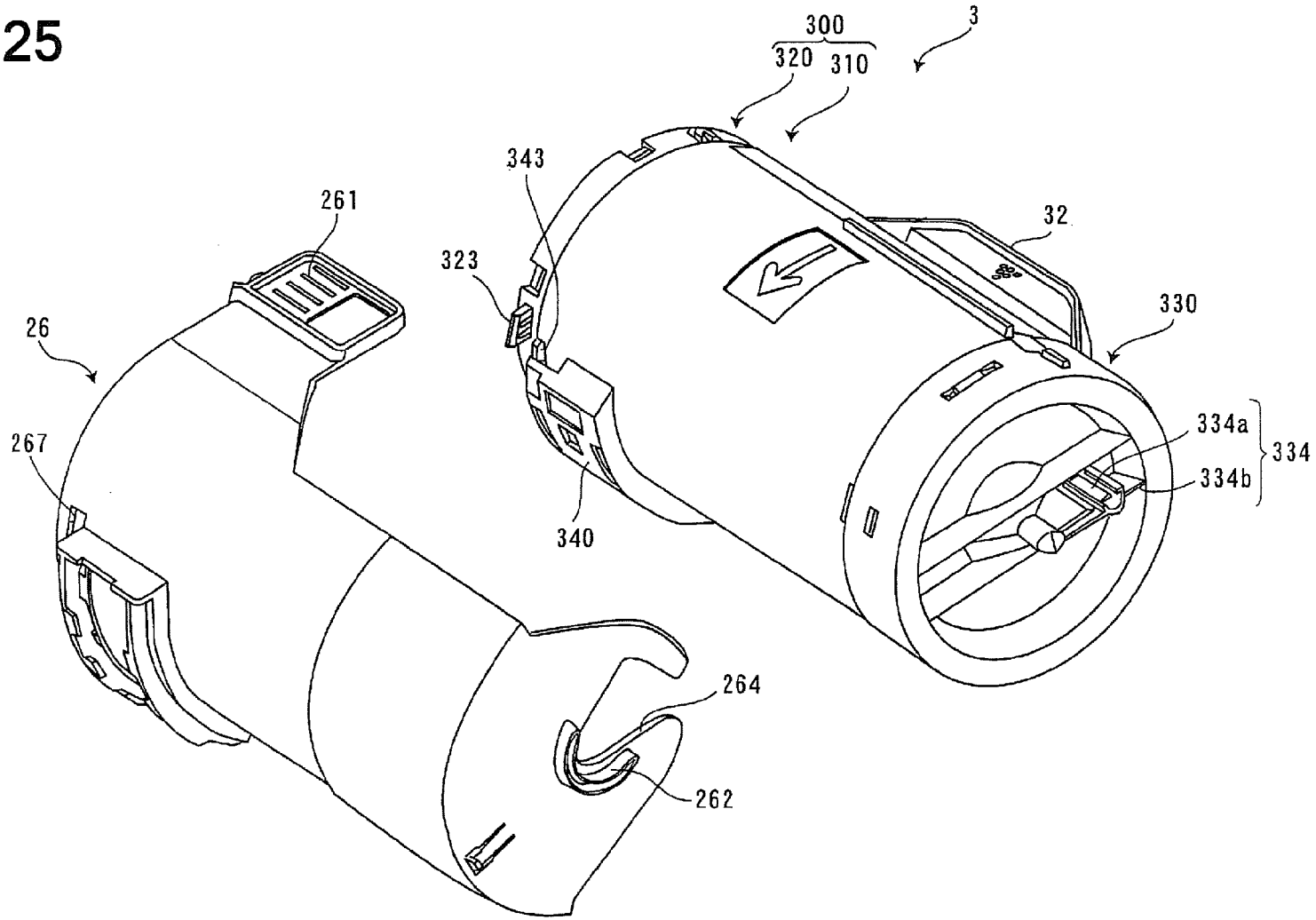
FIG. 25 is a perspective view illustrating the toner cartridge and a fixing member.
Figure 26:
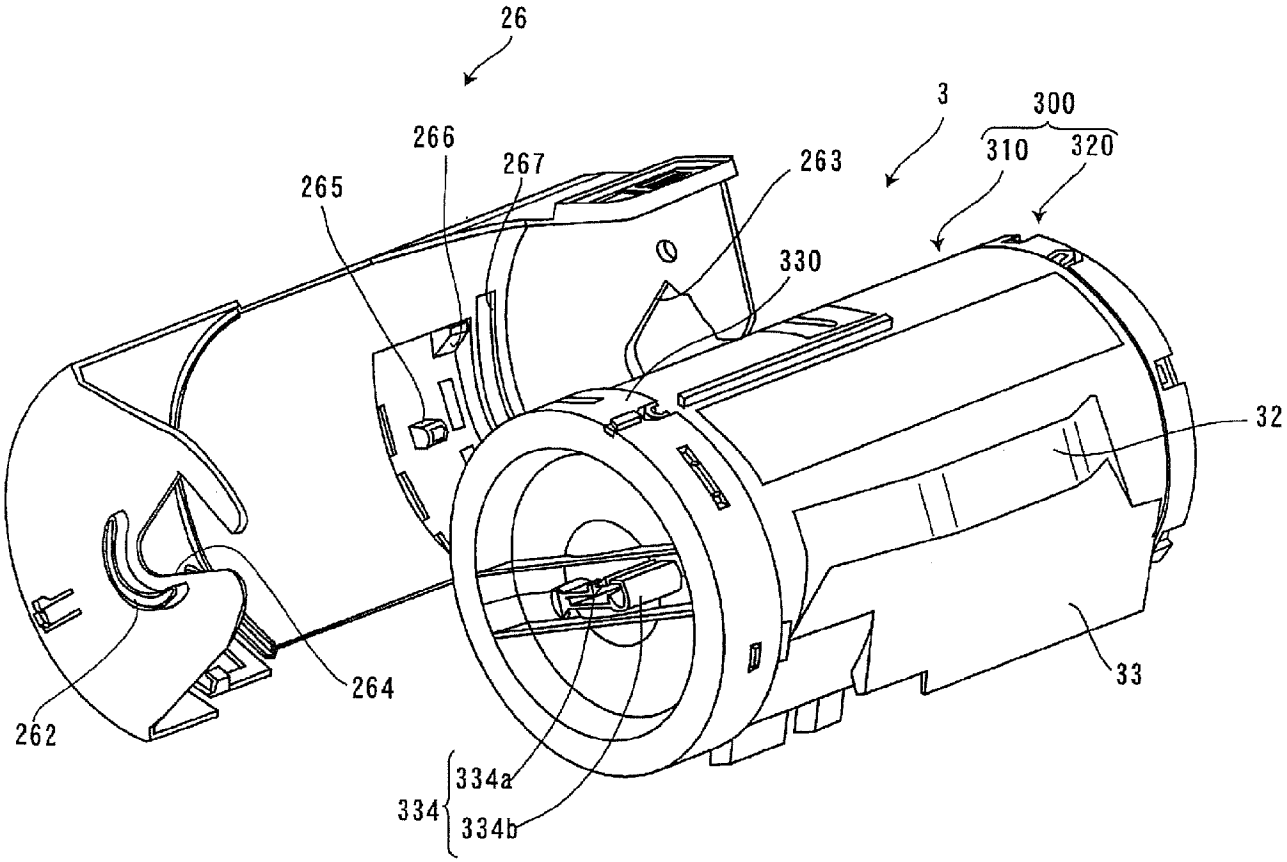
FIG. 26 is a perspective view illustrating the toner cartridge and the fixing member when viewed from a direction different from that of FIG. 25.

FIGS. 25 and 26 are perspective views illustrating the toner cartridge and the fixing member when viewed from directions different from each other.

The fixing member 26 is a member installed in the process cartridge 2 (see FIG. 1) of the apparatus to rotate the knob 261 in a direction of arrow E-F shown in FIG. 1 while a user grips the knob 261.

Here, only the fixing member 26 is removed from the apparatus to be shown together with the toner cartridge 3.

A rib 262 freely rotatably supported by the apparatus, the locker 324 (see, for example, FIG. 7) installed in the first wall 320 of the toner cartridge 3, and cutaway portions 263 and 264 for receiving the locker 334 installed in the second wall 330 are formed on opposite side surfaces of the fixing member 26.

As shown in FIG. 26, a boss 265 and an inclined surface 266 are formed on the inner surface of the fixing member 26, and a slit 267 passing through the inner and outer surfaces of the fixing member 26 is formed in the fixing member 26.

The boss 265 enters into the recess 342 (see FIG. 7) of the shutter 340 when the toner cartridge 3 is mounted to open and close the shutter 340 through rotation of the fixing member 26.

The inclined surface 266 is at a location contacting the movement blocking hook 343 (see FIGS. 7 and 25) when the toner cartridge 3 is mounted, and the movement blocking hook 343 is pushed down by the inclined surface 266 to a location where the shutter 340 can be moved from the closed location toward the opened location.

The boss 323 (see FIGS. 7 and 25) formed in the toner cartridge 3 enters into the slit 267 to determine a rotation range of the fixing member 26.

Figure 27:
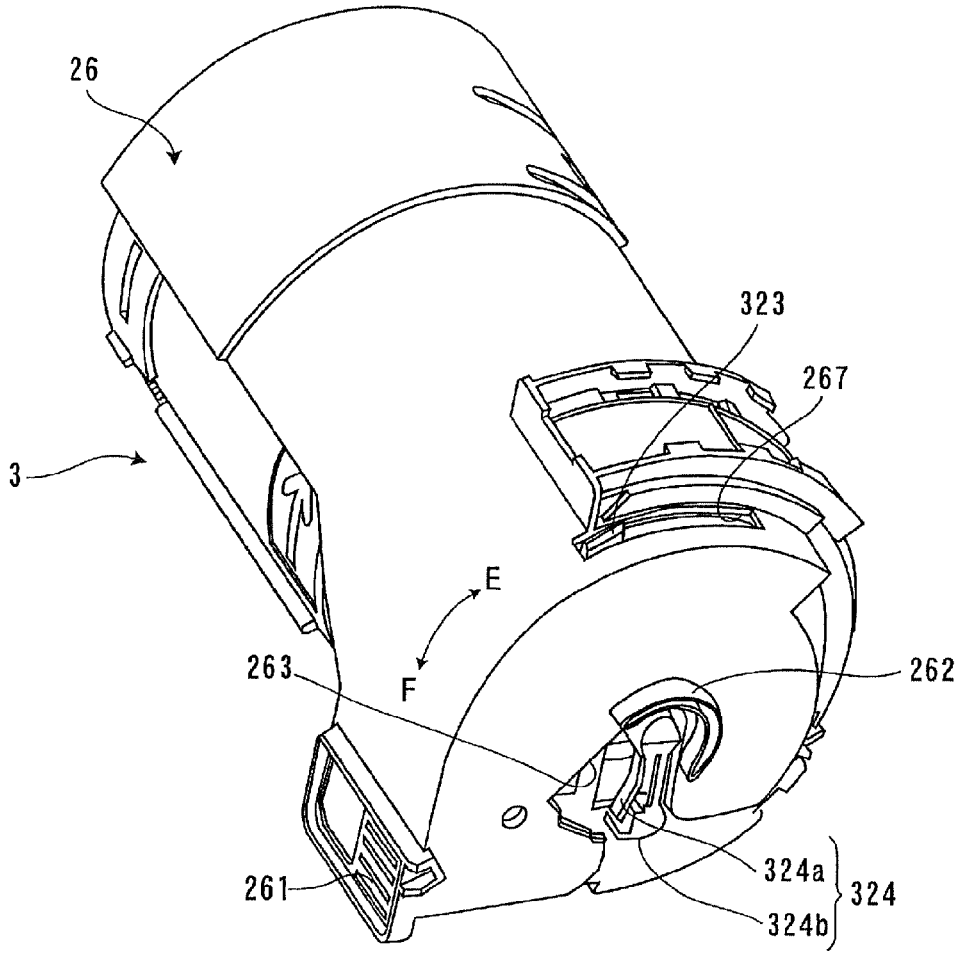
FIG. 27 is a perspective view illustrating a state where the toner cartridge is inserted into the fixing member to be mounted to the apparatus.
Figure 28:
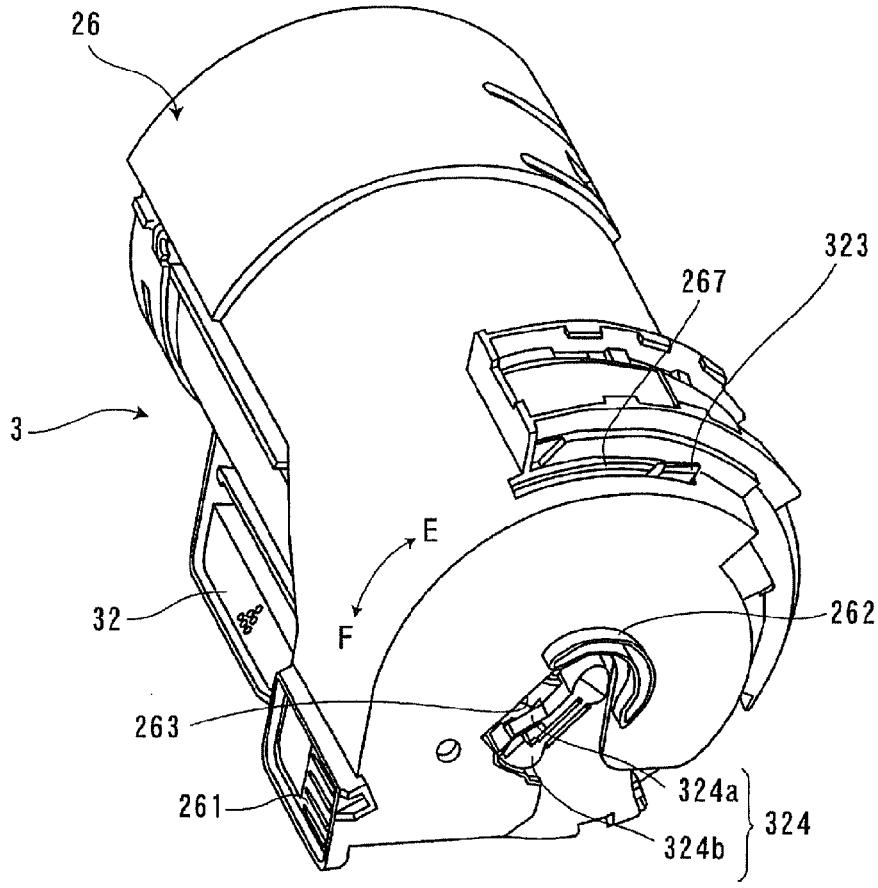
FIG. 28 is a perspective view illustrating a state where the toner cartridge is inserted into the fixing member to be mounted to the apparatus.

FIGS. 27 and 28 are perspective views illustrating a state where the toner cartridge 3 is inserted into the fixing member 26 to be mounted to the apparatus. FIG. 27 is a view before the fixing member 26 is rotated after the toner cartridge 3 is mounted, and FIG. 28 is a view after the fixing member 26 is rotated further.

As shown in FIG. 27, if the toner cartridge 3 is mounted, the boss 323 is inserted into the slit 267. As shown in FIG. 28, if the fixing member 26 is rotated in a direction of arrow F while the knob 261 is gripped, the boss 323 is moved into the slit 267 (a slit 267 side is moved exactly) and collides with a periphery of the slit 267, so that the fixing member 26 cannot be rotated further in the direction of arrow F. Then, the shutter 340 (for example, see FIG. 7) is moving to the opened location.

As shown in FIG. 27, if the toner cartridge 3 is mounted, the locker 324 enters into the cutaway portion 263. As shown in FIG. 25, the locker 334 also enters into the cutaway portion 264. As shown in FIG. 28, if the fixing member 26 is rotated in the direction of arrow F, the second locking portion 324*b* of the locker 324 is pressed by the cutaway portion 263, and is fixed such that the toner cartridge 3 is prevented from being withdrawn from the apparatus. It is the same for the locker 334. The details of the lockers 324 and 334 will be described below.

Now, the shutter opening/closing mechanism will be described again using a cross-section of the shutter portion of the toner cartridge 3.

Figure 29:
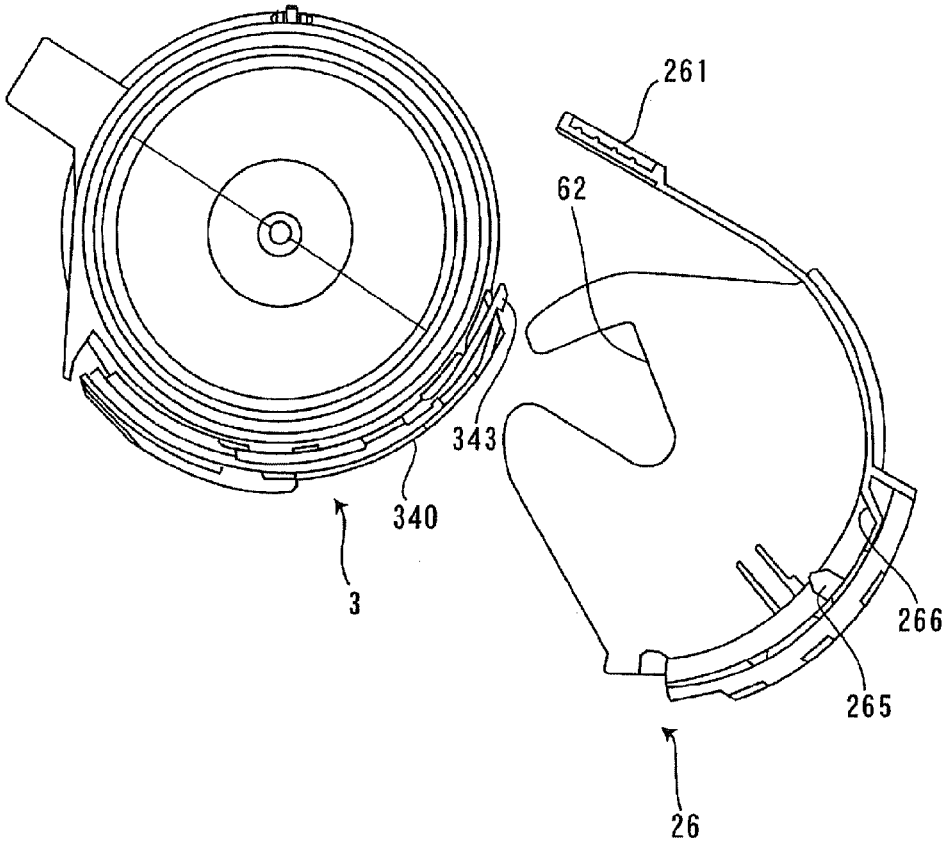
FIG. 29 is a view illustrating the toner cartridge before mounting thereof, and the fixing member for receiving the toner cartridge.

FIG. 29 is a view illustrating the toner cartridge before mounting thereof, and the fixing member receiving the toner cartridge.

FIG. 29 shows the movement blocking hook 343, and the inclined surface 266 pushing down the movement blocking hook 343. FIG. 29 also shows the boss 265 for opening and closing the shutter 340. The movement blocking hook 343 is formed at a front end of the portion extending in a cantilever-shaped shape. The movement blocking hook 343 is raised to a location where the movement blocking hook 343 is hooked by the front end of the shutter 340 in the movement direction thereof to the opened location of the shutter 340. The toner supplying opening 310*a* is closed by the shutter 340.

Figure 30:
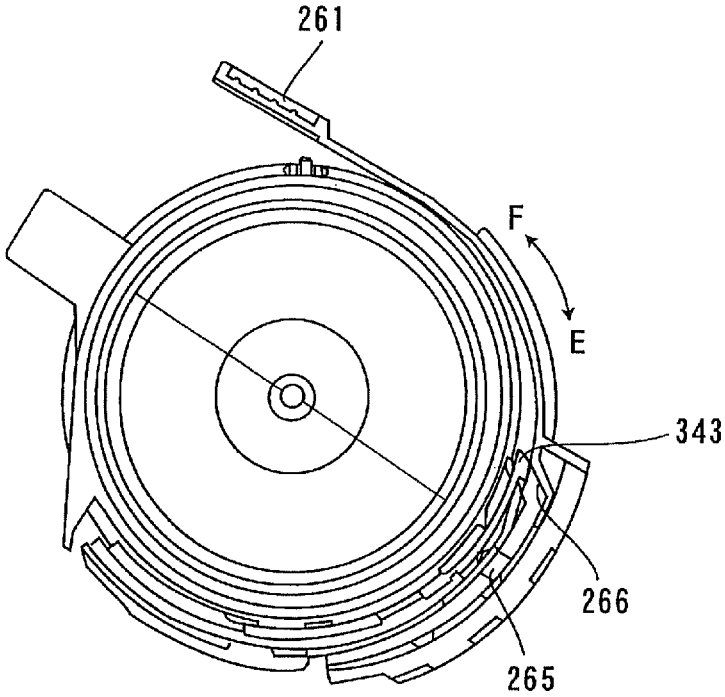
FIG. 30 is a sectional side view illustrating a state before the fixing member is rotated, after the toner cartridge is mounted.
Figure 31:
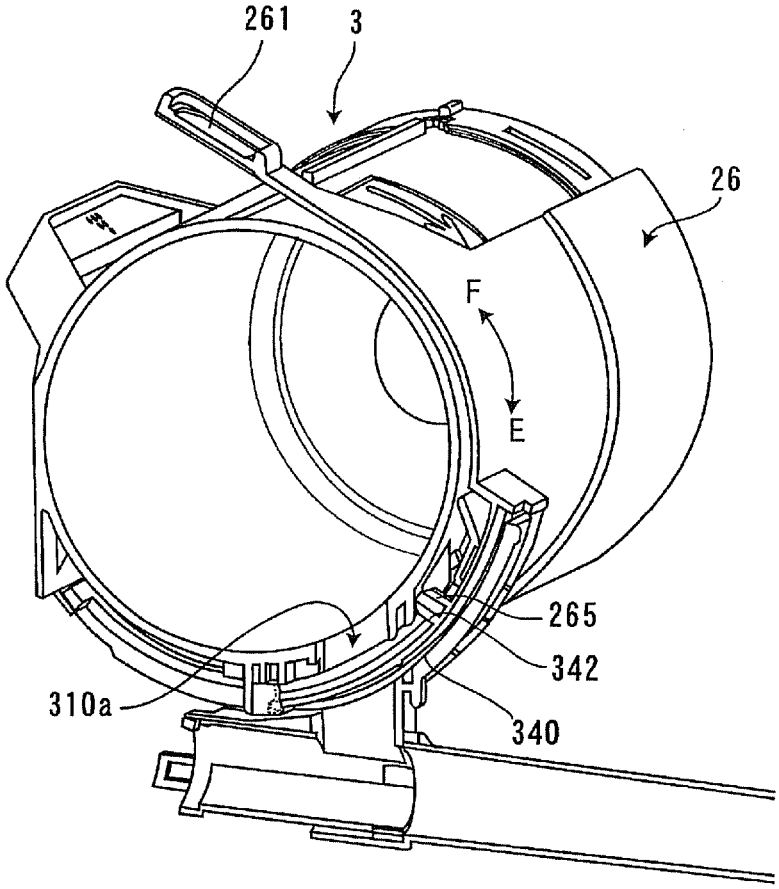
FIG. 31 is a sectional perspective view illustrating the state before the fixing member is rotated, after the toner cartridge is mounted.

FIGS. 30 and 31 are a sectional side view and a sectional perspective view illustrating a state before the fixing member is rotated, after the toner cartridge 3 is mounted. In this case, FIG. 30 is a view illustrating a section of the movement blocking hook 343 and FIG. 31 is a view illustrating a section of the boss 265.

In this step, the movement blocking hook 343 is pressed and pushed down by the inclined surface 266, so that the shutter 340 can be moved. The boss 265 enters into the recess 342 (see FIG. 7) of the shutter 340, and can be rotated in conjunction with the rotation of the fixing member 26. The toner supplying opening 310*a* remains blocked by the shutter 340.

Figure 32:
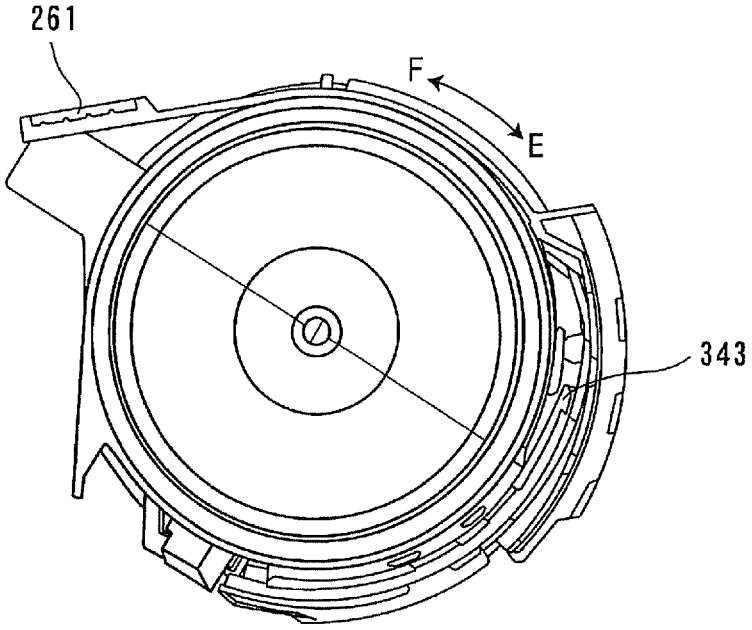
FIG. 32 is a sectional side view illustrating a state where the fixing member is rotated further in the state of FIGS. 30 and 31.
Figure 33:
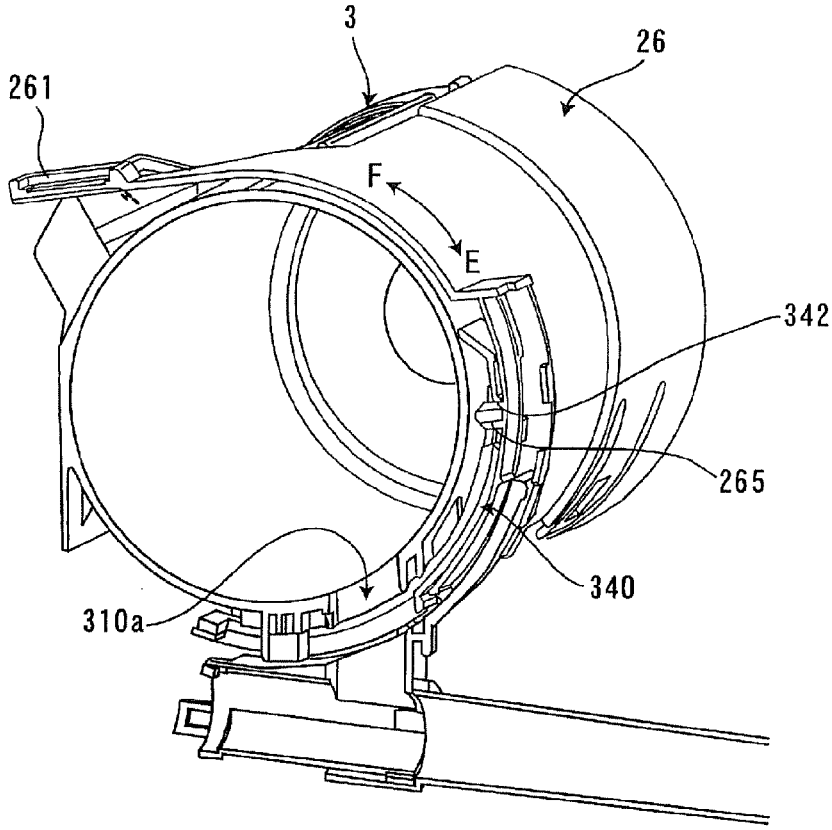
FIG. 33 is a sectional perspective view illustrating the state where the fixing member is rotated further in the state of FIGS. 30 and 31.

FIGS. 32 and 33 are a sectional side view and a sectional perspective view, respectively, illustrating a state where the fixing member 26 is rotated further in the state of FIGS. 30 and 31.

If the fixing member 26 is rotated in the direction of arrow F, the boss 265 having entered into the recess 342 (also, see FIG. 7) moves the shutter 340 to the opened location in the same rotating direction. Then, as shown in FIG. 33, the opening 310*a* is opened, and the toner in the toner cartridge 3 is supplied to the apparatus.

(Lockers)

Next, operations of the lockers installed in the first wall 320 and the second wall (cover) 330 of the toner cartridge 3 will be described.

Figure 34:
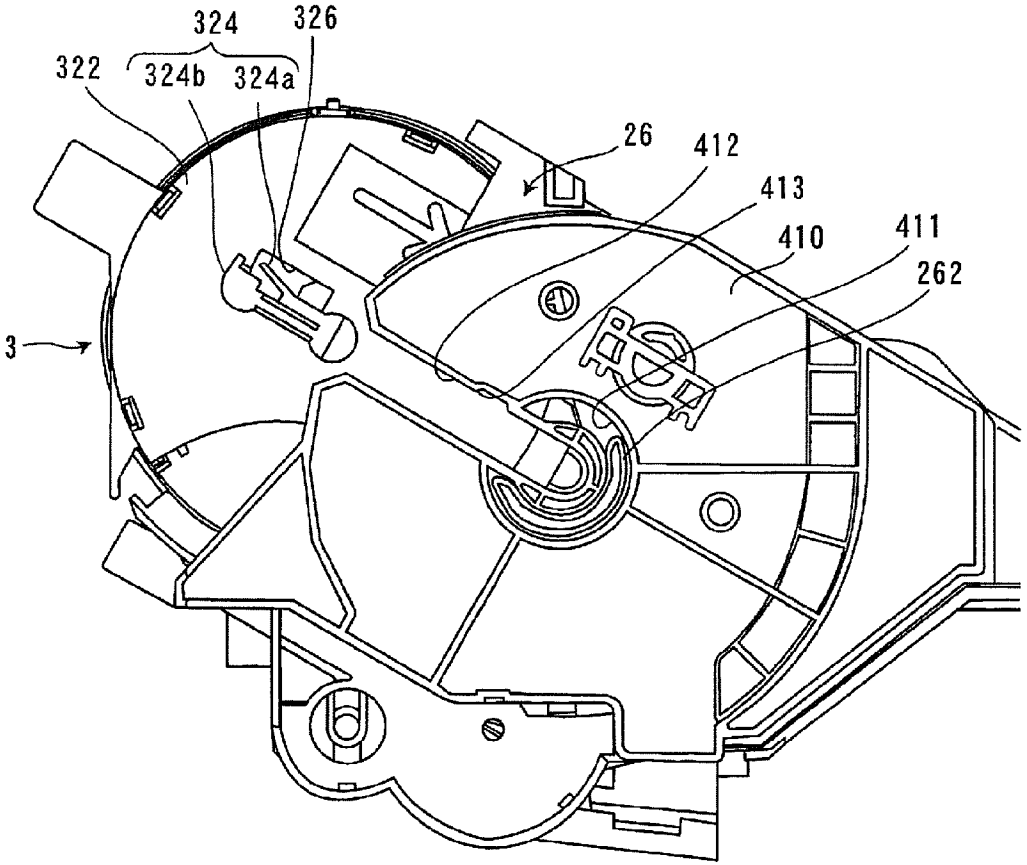
FIG. 34 is a side view illustrating a state where the toner cartridge is mounted, when viewed from the first wall of the toner cartridge.

FIG. 34 is a side view illustrating a state where the toner cartridge 3 is mounted, when viewed from the first wall of the toner cartridge. FIG. 34 shows the toner cartridge 3, the fixing member 26, and a support member 410 constituting the process cartridge 2 (see FIG. 1), for freely rotatably supporting the fixing member 26.

The rib 262 installed on a side surface of the fixing member 26 is installed into an arc-shaped slit 411 installed in the support member 410, and the fixing member 26 is freely rotatably supported by the support member 410. Here, even though the first wall 320 side is shown, the fixing member 26 is freely rotatably supported by the support member 410 in the second wall (cover) 330 side as well.

A long groove 412 extending long to receive the locker 324 is formed in the support member 410, and an end 413 is formed in the groove 412.

As described above, the locker 324 having the first locking portion 324*a* and the second locking portion 324*b* is formed in the cap 322 forming the outer wall surface of the first wall 320 in the first wall 320. For example, as shown in FIG. 7, the locker 324 is formed at a location protruding from the outer surface of the cap 322 toward the outside in the rotation center axis direction. The first locking portion 324*a* constituting the locker 324 has a cantilever-shape extending in a direction perpendicular to a direction following the outer wall surface of the cap 322, that is, the rotation center axis direction. A hole 326 passes through the cap 322. The hole 326 is a hole provided by a need to form the locker 324 having the cantilever-shaped first locking portion 324*a* by molding a resin.

Figure 35:
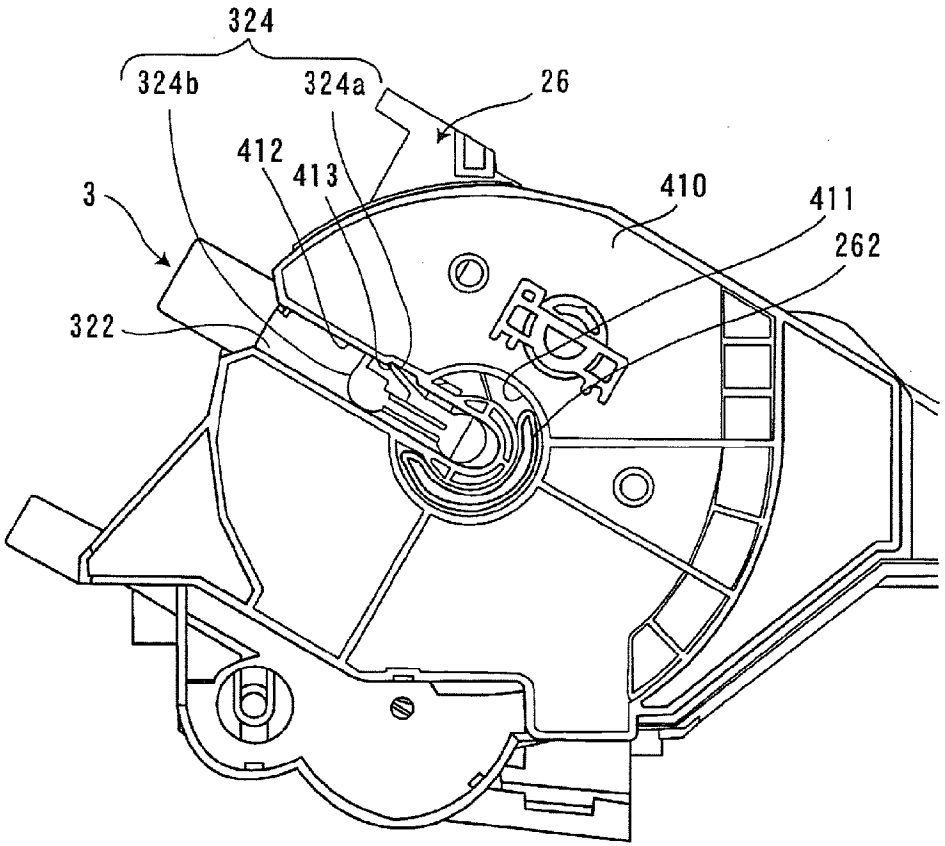
FIG. 35 is a side view illustrating a state before the fixing member is rotated, after the toner cartridge is mounted to the apparatus, when viewed from the first wall of the toner cartridge.

FIG. 35 is a side view illustrating a state before the fixing member is rotated, after the toner cartridge is mounted to the apparatus, when viewed from the first wall of the toner cartridge.

If the toner cartridge is mounted, the locker 324 enters into the groove 412 of the support member 410, and a front end of the first locking portion 324*a* is caught by the end 413 in the groove 412. In this state, if the toner cartridge 3 is pulled and withdrawn strongly to a degree, the first locking portion 324*a* is resiliently deformed to be released from the end 413 so that the toner cartridge 3 can be pulled and withdrawn. However, as long as the toner cartridge 3 is not to be pulled and withdrawn, the first locking portion 324*a* remains caught by the end 413.

As described above, since the gear 321 (see, for example, FIG. 7) for rotating the agitation member 31 (see FIG. 1), the inclined surface 266 (see FIG. 26) pressing the movement blocking hook 343 (see FIG. 7), or the like is disposed in the first wall 320, a repulsive force with a certain magnitude is applied to the toner cartridge 3 if the toner cartridge 3 is mounted to the apparatus. Accordingly, if there is not the first locking portion 324*a*, it is necessary to rotate the fixing member 26 with one hand while the other hand presses the mounted toner cartridge 3.

In the state where the first locking portion 324*a* is caught by the end 413, the movement blocking hook 343 can be pressed by the inclined surface 266 to move the shutter 340, and if the toner cartridge 3 is mounted until a first locking portion 343*a* is caught by the end 413, a hand is released from the toner cartridge 3 and the knob 261 of the fixing member 26 is gripped by the hand, so that the toner cartridge 3 is completely mounted by rotating the fixing member 26.

Figure 36:
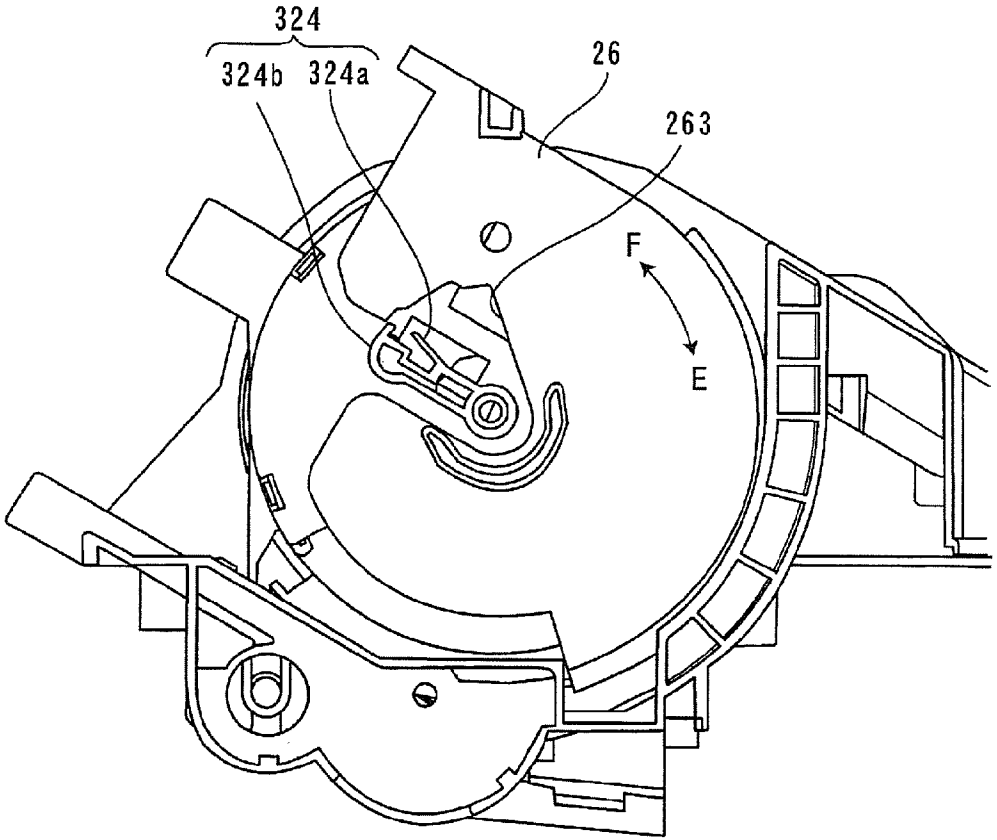
FIG. 36 is view illustrating a state before the fixing member is rotated, after the toner cartridge is mounted, as in FIG. 35, with a side thereof immediately in front of the support member being separated.

FIG. 36 is view illustrating a state before the fixing member is rotated, after the toner cartridge is mounted, as in FIG. 35, with a wall surface thereof immediately in front of the support member 410 being separated. FIG. 36 is a view showing the fixing member 26 inside the support member 410.

In this state, even through the locker 324 is received by the cutaway portion 263 of the fixing member 26, the locker 324 does not interfere with the cutaway portion 263. As shown in FIG. 35, in this state, the first locking portion 324*a* of the locker 324 remains caught by the end 413 of the support member 410 located outside the fixing member 26.

Figure 37:
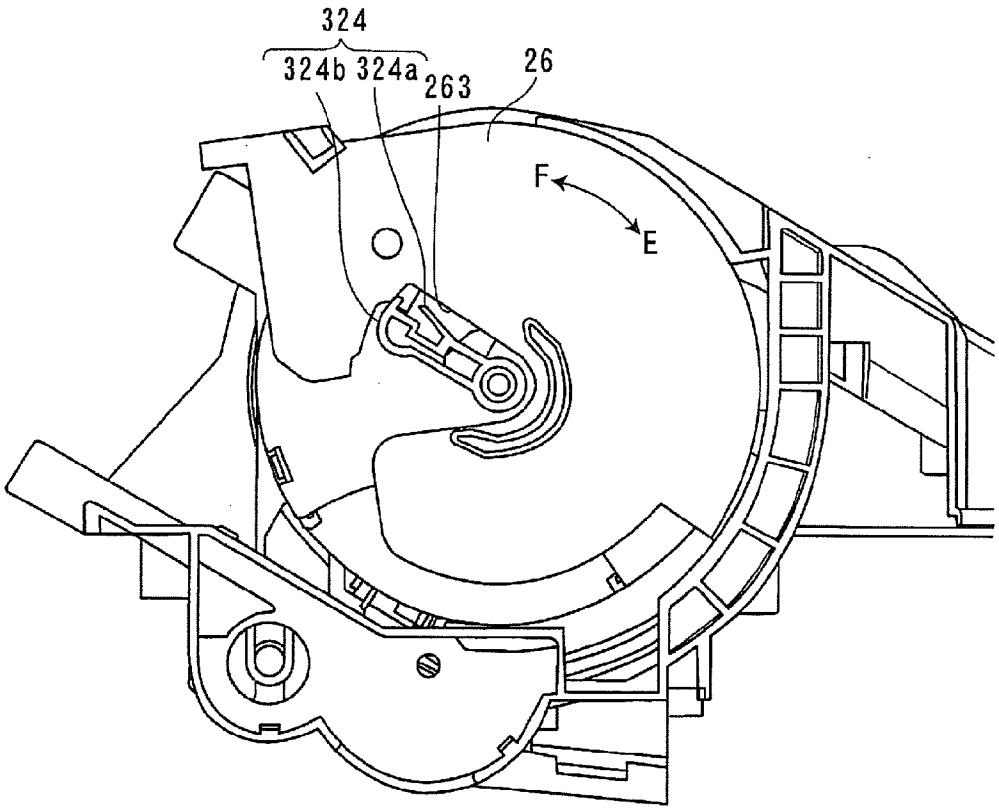
FIG. 37 is a view illustrating a state where the fixing member is rotated in a direction of arrow F from the state of FIG. 36.

FIG. 37 is a view illustrating a state where the fixing member 26 is rotated in the direction of arrow F from the state of FIG. 36. As in FIG. 36, FIG. 37 shows a state where the support member 410 is removed.

If the fixing member 26 is rotated in the direction of arrow F, the shutter is moved to the opened location as described above, and as shown in FIG. 37, the second locking portion 324*b* is pressed in the mounting direction by the cutaway portion 263 of the fixing member 26, preventing the toner cartridge 3 from being withdrawn with certainty.

Figure 38:
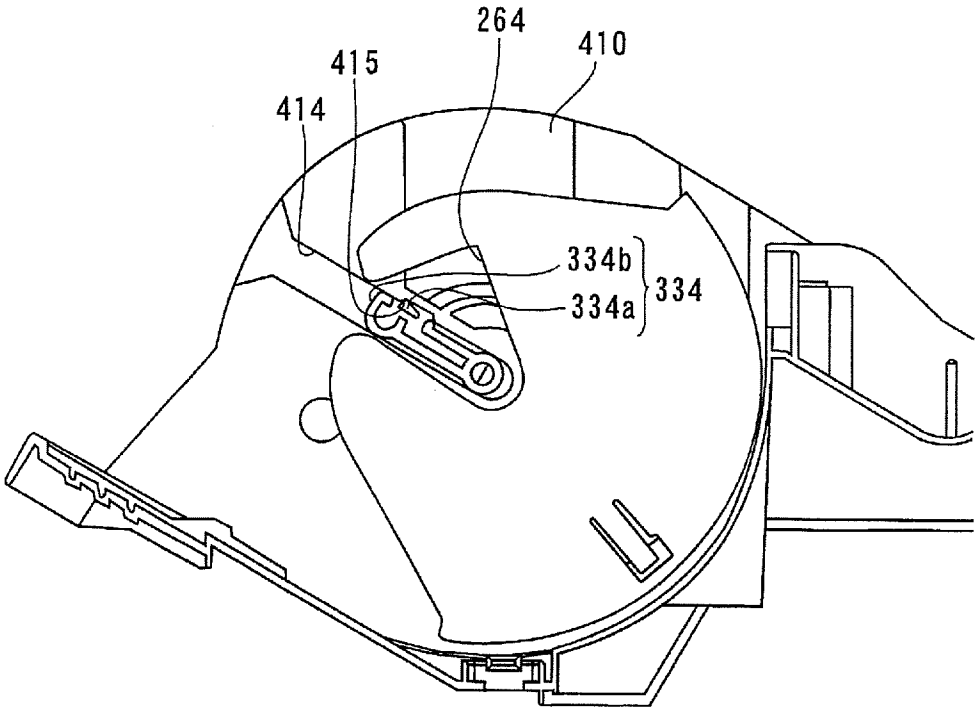
FIG. 38 is a view illustrating a locker of the second wall (cover) of the toner cartridge.
Figure 39:
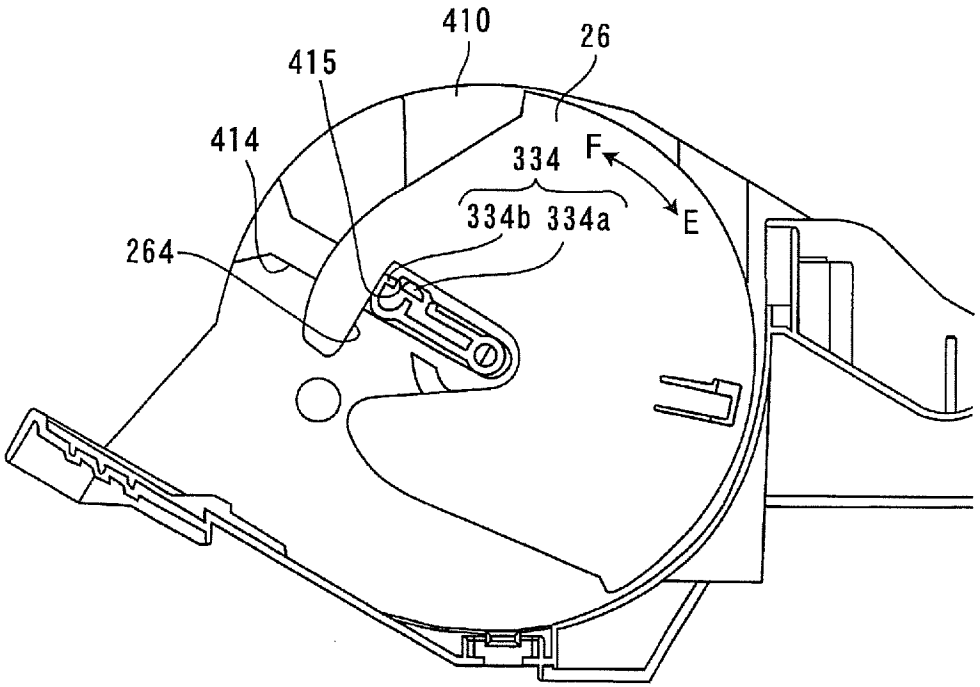
FIG. 39 is a view illustrating a state where the shutter is opened by rotating the fixing member from the state of FIG. 38.

FIG. 38 is a view illustrating a locker of the second wall (cover) of the toner cartridge. FIG. 38 and FIG. 39 which will be described below are views of the second wall (cover) side when viewed from the inner side of the toner cartridge and show a state where the toner cartridge itself is removed except for the locker.

The locker 334 having the first locking portion 334*a* and the second locking portion 334*b* is installed in the second wall (cover) of the toner cartridge 3. The locker 334 has a shape protruding from the second wall (cover) 330 toward the outside in the rotation center axis direction (see FIGS. 25 and 26). Here, unlike the first locking portion 324*a* (see, for example, FIG. 27) of the first wall 320, the first locking portion 334*a* constituting the locker 334 has a cantilever-shape extending to the outside in the rotation center axis direction. This is because as the toner needs to be sealed, the hole 326 (see FIG. 34) for molding cannot be formed in the second wall (cover) 330 like the cap 322 constituting the first wall 320.

The first locking portion 334*a* of the second wall (cover) 330 has a short length between the fixing end and the free end thereof as compared with the first locking portion 324*a* of the first wall 320. This is because when the toner cartridge 3 is mounted to the apparatus, a repulsive force on the second wall 330 is smaller than that on the first wall 320 so that the repulsive forces can be balanced by making a length of the first locking portion 334*a* shorter. That is, by catching the side having the smaller repulsive force weak, the toner cartridge 3 can be easily pulled and withdrawn in parallel to the rotation center axis when the toner cartridge 3 is pulled and withdrawn.

A groove 414 is formed in the support member 410 on the second wall (cover) 330 side, and an end 415 catching the first locking portion 334*a* is formed in the support member 410. If the toner cartridge 3 is mounted, the first locking portion 334*a* is caught by the end 415. Here, the first locking portion 334*a* of the second wall (cover) 330 is caught by the end 415 with a locking force weaker than a magnitude of the locking force produced as the first locking portion 334*a* is caught by the end 413 of the first locking portion 324*a* of the first wall 320. As described above, this is to allow the first locking portions 324*a* and 334*a* to be released from the ends 413 and 415 with the same-leveled left and right forces when the toner cartridge 3 is pulled and withdrawn.

FIG. 39 is a view illustrating a state where the shutter is opened by rotating the fixing member from the state of FIG. 38.

If the fixing member 26 is rotated in the direction of arrow F, the second locking portion 334*b* is pressed by the cutaway portion 264 of the fixing member 26, preventing the toner cartridge 3 from being withdrawn with certainty.

(Shutter Maintaining Structure)

Next, a description will be made as to a structure that enables the shutter 340 to be maintained openable/closable with respect to the body 310.

As illustrated in FIG. 23, the body 310 is provided with a pair of guide portions 360 that guide the movement of the shutter 340 as well as maintain the shutter 340 to the body. The pair of guide portions 360 are arranged in the longitudinally opposite sides of the body 310 with an opening 310*a* being interposed therebetween. Each of guide portions 360 of the pair extends in the directions of moving the shutter 340 (directions of arrows H, G) as illustrated in FIG. 21, along the edges of the opening 310*a*. The pair of guide portions 360 extend longer than the edges of the opening 310*a*, and the front end of one of the guide portions 360 in the H direction is formed with a movement blocking hook 343.

Herein, a description will be made in more detail with reference to FIG. 9 again. The pair of guide portions 360 in the present exemplary embodiment are formed integrally with the body 310 and shaped to protrude opposite to each other in the longitudinal direction. The guide portions 360 protrude from the outer surface of the body 310 with a gap therebetween. The shutter 340 is maintained by the guide portions 360 to be positioned on the outer surface of the body 310 by grasping the pair of oppositely protruding guide portions 360 at the opposite sides thereof in the longitudinal direction of the body 310. That is, the guide portions 360 are disposed in the inner side of the shutter 340. The guide portions 360 serve as a rail to guide the movement of the shutter 340 in the directions where the guide portions 360 extend, i.e., the movement directions (directions of arrows H, G) as illustrated in FIG. 21, while maintaining the inner side of the shutter 340.

The inner side of the shutter 340 is formed with a seal member (not illustrated) made out of polyurethane, and the seal member is opposed to the opening 310*a* in the inner side of the shutter 340 in the state where the shutter 340 closes the opening 310*a*. In the state where the shutter 340 is maintained by the guide portions 360, the seal member becomes a deformed state from the free length thereof, thereby preventing the leakage of the toner, and at the same time, generating a drag against the movement of the shutter 340.

The above-described boss 323 is a separate part as to the guide portions 360, and protrudes to a location spaced away from the guide portions 360. The boss 323 is also disposed in a location spaced away from the shutter 340 maintained by the guide portions 360 so that the boss is not in contact with the shutter 340. Accordingly, the impact transferred to the guide portions 360 and the shutter 340 when the boss 323 receives the impact from the outside is reduced as compared to a case where the boss 323 is provided to be in contact with the guide portions 360 or the shutter 340. The guide portions 360 are disposed in the inner side of the shutter 340, and are not exposed to the outer surface of the toner cartridge 3.

The boss 323 is formed in a place parallel to the end of the shutter 320 disposed in the closed location, and the boss 323, the end of the shutter 340 and the movement blocking hook 343 are overlapped when viewed from the longitudinal direction of the body 310.

Meanwhile, a direction sign 327 as illustrated in FIGS. 7 and 8 indicates the mounting direction for mounting the toner cartridge 3 to the apparatus. In the above-described exemplary embodiments, the pair of guide portions 360 formed integrally with the body 310 and protruding in the opposite directions from each other are represented as an example of the guide portions mentioned in the present invention. However, the present invention is not limited thereto, and the guide portions may be attached to the body as, for example, a separate member as to the body. The guide portions may be installed in a location where, for example, the guide portions protrude in the opposite directions from each other or have recesses on the opposite surfaces, such that the shutter is interposed between the opposite sides.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A powder container comprising:

a body; and a pair of walls that block one end in a longitudinal direction of the body and the other end of the body, respectively, the powder container accommodating powder therein and being mounted in an apparatus that uses the powder, wherein the body has an opening in a location closer to the one end of the body to supply the powder within the powder container to the apparatus, wherein the powder container further includes:

a shutter that is situated in a closed location to block the opening before the powder container is mounted in the apparatus and is moved along an outer peripheral surface of the body to an opened location to open the opening in a state where the powder container is mounted in the apparatus, a guide portion that maintains the shutter on the body and guides a movement of the shutter, and a boss that is positioned in a location between the shutter and an outer wall surface of the one of walls in the longitudinal direction of the body and next to the end of the shutter disposed in the closed location in a movement direction of the shutter, and protrudes outward in a radial direction from a center line of the body in the longitudinal direction, wherein the shutter receives an action from a movable member of the apparatus to open the opening in a state where the powder container is mounted in the apparatus, and wherein the boss contacts with the movable member of the apparatus when the shutter moves from the closed location to the opened location by the movement of the movable member after the powder container is mounted in the apparatus and blocks a further movement of the movable member in a direction where the shutter is further opened.

2. The powder container according to claim 1, wherein the guide portion is disposed in an inner side of the shutter.

3. The powder container according to claim 1, further comprising a blocking hook formed in a location adjacent to the end of the shutter disposed in the closed location, wherein before the powder container is mounted in the apparatus, the blocking hook protrudes up to a height to prevent the shutter disposed in the closed location from being moved from the closed location to the opened location, and by being mounted in the apparatus, the blocking hook is pressed by a member of the apparatus and pushed down up to a height to allow the movement of the shutter, and wherein the boss has a width in the movement direction of the shutter so that the boss is next to the end of the shutter and is next to the blocking hook with respect to the movement direction of the shutter.

4. The powder container according to claim 3, wherein the boss protrudes outward in the radial direction higher than a radial front end of the blocking hook in a protruding state from the center line.

5. An image forming apparatus which is mounted with a powder container according to claim 1 to form an image using the powder accommodated within the powder container.

* * * * *